US012584308B2

(12) United States Patent
Hallgren

(10) Patent No.: US 12,584,308 B2
(45) Date of Patent: Mar. 24, 2026

(54) UNIVERSAL ANCHOR FOR USE WITH A GRATING FRAME

(71) Applicant: Ohio Gratings, Inc., Canton, OH (US)

(72) Inventor: Ryan Christopher Hallgren, Clinton, OH (US)

(73) Assignee: Ohio Gratings, Inc., Canton, OH (US)

( * ) Notice: Subject to any disclaimer, the term of this patent is extended or adjusted under 35 U.S.C. 154(b) by 216 days.

(21) Appl. No.: 18/347,903

(22) Filed: Jul. 6, 2023

(65) Prior Publication Data

US 2025/0012073 A1 Jan. 9, 2025

(51) Int. Cl.
*E04B 1/41* (2006.01)

(52) U.S. Cl.
CPC ..... *E04B 1/41* (2013.01)

(58) Field of Classification Search
CPC .. E04B 1/41; E03F 5/06; E03F 5/0401; E03F 2005/063; E03F 5/041
See application file for complete search history.

(56) References Cited

U.S. PATENT DOCUMENTS

| | | | | |
|---|---|---|---|---|
| 3,474,589 | A | 10/1969 | Cheatwood | |
| 3,974,609 | A * | 8/1976 | Attaway | E04B 1/6804 14/73.1 |
| 5,897,086 | A | 4/1999 | Condon | |
| 6,595,720 | B2 * | 7/2003 | Humphries | E03F 3/046 405/118 |
| D497,678 | S | 10/2004 | Brabeck | |
| 7,175,143 | B1 | 2/2007 | Ho | |
| D666,894 | S | 9/2012 | Bombino et al. | |
| D672,015 | S | 12/2012 | Luke | |
| D674,221 | S | 1/2013 | Kim | |
| 8,627,627 | B2 * | 1/2014 | Findlay | E04B 1/68 52/396.05 |
| D727,716 | S | 4/2015 | Längle | |

(Continued)

FOREIGN PATENT DOCUMENTS

| | | | |
|---|---|---|---|
| KR | 101103076 B1 | * | 1/2012 |
| KR | 20120038189 A | * | 4/2012 |

OTHER PUBLICATIONS

16"×16"×1" Galvanized Grate with Angle Iron Frame sold by Rockcrete USAR Accessed on May 24, 2023 URL: https://rockcreteusa.com/product/16×16-×-1%E2%80%B3-galvanized-grate-with-angle-iron-frame/?utm_source=Google+Shopping&utm_medium=cpc&utm_campaign=Shopping&gclid=EAIaIQobChMInf_htaSO_wIVfRatBh0vxw10EAQYBSABEgKMBfD_BwE.

(Continued)

*Primary Examiner* — Theodore V Adamos
(74) *Attorney, Agent, or Firm* — Sand, Sebolt & Wernow Co., LPA

(57) ABSTRACT

A grate frame assembly including an embed grate frame and an anchor which is installed on the embed grate frame onsite without tools or welding. The embed grate frame includes a main body, a protrusion, and a leg. The anchor has a body with a support end and an attachment end. The attachment end is selectively engaged with the protrusion. The leg of the embed grate frame is configured to engage a concrete form. The support end of the installed anchor contacts a wall located a distance from the concrete form. Together, the anchor and the leg on the embed grate frame hold the main body in place so that a compound material can be poured into a free space defined between the wall and the concrete form. The compound material secures the embed grate frame into a surface such as a sidewalk or road.

15 Claims, 19 Drawing Sheets

(56) References Cited

U.S. PATENT DOCUMENTS

| | | | | |
|---|---|---|---|---|
| D781,681 | S | 3/2017 | Nagaki et al. | |
| D849,270 | S | 5/2019 | Singh | |
| D860,762 | S | 9/2019 | Gibson | |
| D872,677 | S | 1/2020 | Keen | |
| D950,022 | S | 4/2022 | Smerdon | |
| D1,003,630 | S | 11/2023 | Gallien | |
| D1,021,150 | S | 4/2024 | Griffith et al. | |
| D1,022,255 | S | 4/2024 | Hodges | |
| D1,025,398 | S | 4/2024 | Ettinger | |
| D1,026,622 | S | 5/2024 | Hong et al. | |
| D1,027,616 | S | 5/2024 | Guerrera et al. | |
| D1,032,335 | S | 6/2024 | Johnson et al. | |
| D1,034,172 | S | 7/2024 | Morehouse | |
| D1,036,970 | S | 7/2024 | More et al. | |
| D1,042,094 | S | 9/2024 | Jiménez | |
| D1,059,162 | S | 1/2025 | Chen | |
| 2010/0050552 | A1* | 3/2010 | David | B28B 23/02 52/582.1 |
| 2011/0008104 | A1* | 1/2011 | Knak | E03F 5/06 404/4 |
| 2023/0071860 | A1 | 3/2023 | Chen et al. | |

OTHER PUBLICATIONS

Aluminum Grating Frames, available in brown-campbell.com, earliest available date on Wayback Apr. 28, 2016 [online], Retrieved on Sep. 10, 2025 from URL: https://www.brown-campbell.com/products/info?page=bar-grating&cmsID=bar-grating-aluminum-grating-frames (Year: 2016).

* cited by examiner

UNIVERSAL ANCHOR FOR USE WITH A GRATING FRAME

TECHNICAL FIELD

The present disclosure relates generally to grating installed in sidewalks or roads. More particularly, the present disclosure relates to a grating frame assembly that includes anchors which help to retain the grate frame assembly in position during installation of the grate frame assembly in a sidewalk or road. Specifically, the present disclosure is directed to a grating frame assembly comprising an embed grate frame and a plurality of separate anchors which are able to be secured to the embed grate frame on the jobsite without tools and, more particularly, without welding.

BACKGROUND ART

Grating assemblies configured for supporting vehicle and/or pedestrian traffic are commonly used on sidewalks and road surfaces requiring venting and/or drainage therethrough. Often these grating systems are configured to permit variously-sized wheels and/or foot traffic to pass thereover without catching or presenting a hazard thereto. Typically, as such grating assemblies are installed in areas where they are easily seen and not easily concealed, they are typically designed to be functional while also being aesthetically pleasing.

Grating assemblies are commonly configured to have at least one anchor to support the embed grate frame in place during installation. These anchors are welded onto the embed grate frame at predetermined intervals. The welding of the anchors onto the embed grate frame typically occurs during fabrication of the embed frame at a factory. The embed grate frame with its plurality of welded anchors is then shipped to a jobsite for installation. Shipping the embed grate frames with installed anchors is expensive and it is not uncommon for anchors to be broken off of the embed grate frame during shipment. When anchors break off the embed grate frame then the installers either have to fix the embed grate frame by welding the anchors back onto the same or another undamaged embed grate frame has to be used instead of the damaged embed grate frame. Repairing damaged embed grate frames or using alternative embed grate frames causes construction delays and increases the cost of installation of the grate frame assembly.

SUMMARY OF THE INVENTION

A grate frame assembly including an embed grate frame and a plurality of separate anchors which are installed on the embed grate frame onsite without tools or welding is disclosed herein. The embed grate frame includes a main body, a protrusion, and a leg. Each anchor has a body with a support end and an attachment end. The attachment end is selectively engaged with the protrusion. The leg of the embed grate frame is configured to engage a concrete form. The support end of each installed anchor contacts a wall located a distance from the concrete form. Together, the anchors and the leg on the embed grate frame hold the main body in place within an opening defined in a sidewalk or road. When the embed grate frame is correctly positioned, a compound material is poured into a free space defined between the wall and the concrete form. The compound material secures the embed grate frame and the anchors into the sidewalk or road. Bearing bars are installed with the embed grate frame.

In one aspect, an exemplary embodiment of the present disclosure provides an embed grate frame for a grate frame assembly. The embed grate frame comprises a main body configured to engage a bearing bar of the grate frame assembly. The embed grate frame also comprises a protrusion provided on the main body, said protrusion being configured to be selectively engaged with at least one anchor. The embed grate frame also comprises a leg provided on the main body; wherein the leg is spaced from the protrusion and is configured to be selectively engaged with at least one concrete form.

This exemplary embodiment or another exemplary embodiment may further include that the embed grate frame also comprises a first arm; a second arm; wherein the first arm and the second arm intersect one another; and wherein the protrusion extends outwardly from at least one of the first arm and the second arm. This exemplary embodiment or another exemplary embodiment may further include that the protrusion has a length measured from the intersection of the first arm and the second arm to a terminal end of the protrusion, and wherein the length of the protrusion is less than a width of either of the first arm or the second arm, wherein the width of each of the first arm and the second arm is measured from the intersection to a terminal end of the associated first arm or second arm. This exemplary embodiment or another exemplary embodiment may further include that the protrusion of the embed grate frame is substantially T-shaped and has a stem with a first flange and a second flange extending outwardly from the stem. This exemplary embodiment or another exemplary embodiment may further include that the protrusion further comprises: a stem extending from the main body and having a first side and a second side; a first flange extending from the stem; a second flange extending from the stem; wherein the first flange comprises a first surface and a second surface opposite one another; and wherein the first surface of the first flange is continuous with the first side of the stem. This exemplary embodiment or another exemplary embodiment may further include that the second flange further comprises: a first edge and a second edge opposite one another; a first end extending from the first edge to the second edge; and wherein the first edge of the second flange is continuous with the second side of the stem. This exemplary embodiment or another exemplary embodiment may further include that the leg comprises: a first region extending outwardly from the main body; and a second region extending outwardly from the first region; wherein the first region is of a first configuration and the second region is of a second configuration which is different from the first configuration; and wherein the second region is adapted to engage the concrete form. This exemplary embodiment or another exemplary embodiment may further include that the first region and the second region intersect one another at a corner and the corner is adapted to receive a top end of the concrete form therein. This exemplary embodiment or another exemplary embodiment may further include that the corner is of angle of at least 90 degrees measured between a first surface of the first region and a first side of the second region. This exemplary embodiment or another exemplary embodiment may further include that the second region is substantially aligned with a point on the first arm of the main body, and the point is located furthest from the intersection of the first arm and the second arm. This exemplary embodiment or another exemplary embodiment may further include that the first region is curved and the second region is straight. This exemplary embodiment or another exemplary embodiment may further include that the first region is convex with respect to the protrusion and the second region is parallel to the second arm of the main body. This exemplary embodiment or another exemplary embodiment may further include that a radius of curvature of the convex first region is at least 0.5 inches. This exemplary embodiment or another exemplary embodiment may further include that the leg extends outwardly for a first distance from the main body and the protrusion extends outwardly from the main body for a second distance, and wherein the first distance is greater than the second distance.

In another aspect, an exemplary embodiment of the present disclosure may provide a method. The methods may comprise steps of installing a wall; installing a concrete form a distance from the wall; extending a leg of an embed grate frame outwardly from a main body of the embed grate frame; placing the leg on the concrete form; attaching at least one anchor with the embed grate frame; abutting the at least one anchor against the wall; filling a free space defined between the wall and the concrete form with a compound material; securing a portion of the embed grate frame and the at least one anchor in place with the compound material.

This exemplary embodiment or another exemplary embodiment may further include that attaching the at least one anchor with the embed grate frame includes engaging the at least one anchor with a protrusion extending outwardly from the embed grate frame at a jobsite. This exemplary embodiment or another exemplary embodiment may further include attaching the at least one anchor with the embed grate frame includes engaging the at least one anchor with the protrusion and thereby the main body of the embed grate frame without welding or tools. This exemplary embodiment or another exemplary embodiment may further include the at least one anchor is removably engaged with the protrusion of the embed grate frame. This exemplary embodiment or another exemplary embodiment may further include the at least one anchor snap-fittingly engages the protrusion of the embed grate frame. This exemplary embodiment or another exemplary embodiment may further include the embed grate frame is installed without the main body of the embed grate frame touching the concrete form.

In another aspect, and exemplary embodiment of the present disclosure may provide an anchor for a grate frame. The anchor comprises a body. The anchor also comprises a support end provided on the body, said support end being configured to engage at least one wall. The anchor further comprises an attachment end provided on the body opposite the support end, said attachment end being configured to detachably engage the body with an embed grate frame.

This exemplary embodiment or another exemplary embodiment may further include that the attachment end comprises: a first ledge and a second ledge extending outwardly in a same direction from the body; a first side extending between the first ledge and the second ledge; a channel bounded and defined by the first ledge, the first side, and the second ledge; and wherein the channel is adapted to detachably receive a portion of the embed grate frame therein. This exemplary embodiment or another exemplary embodiment may further include that the first ledge comprises: a first surface and a second surface opposite one another; a first end extending between the first surface and the second surface; and a slot defined by a junction between the second surface and the first end. This exemplary embodiment or another exemplary embodiment may further include that the second ledge comprises: a first surface and a second surface opposite one another; a first end extending between the first surface and the second surface of the second ledge; a passage defined by the junction between the first surface and the first end of the second ledge; and an inset defined by a junction between the second surface of the second ledge and the body of the anchor. This exemplary embodiment or another exemplary embodiment may further include that the second ledge extends further outwardly from the attachment end of the body than does the first ledge. This exemplary embodiment or another exemplary embodiment may further include that the first end of the first ledge is enlarged. This exemplary embodiment or another exemplary embodiment may further include that the first end of the first ledge is bulbous. This exemplary embodiment or another exemplary embodiment may further include that the first end of the second ledge is enlarged. This exemplary embodiment or another exemplary embodiment may further include that the first end of the second ledge is hooked. This exemplary embodiment or another exemplary embodiment may further include that the support end extends outwardly from the body of the anchor.

In another aspect, and exemplary embodiment of the present disclosure may provide a grate frame assembly. The grate frame assembly comprises an embed grate frame. The grate frame assembly also comprises at least one anchor wherein the at least one anchor is removably attachable to the embed grate frame.

This exemplary embodiment or another exemplary embodiment may further include that the embed grate frame comprises: a main body; a protrusion extending outwardly from the main body; and wherein the at least one anchor removably attaches to the protrusion. This exemplary embodiment or another exemplary embodiment may further include that the embed grate frame comprises: a main body; a leg extending outwardly from the main body; wherein the leg is configured to engage at least one concrete form. This exemplary embodiment or another exemplary embodiment may further include that the main body of the embed grate frame comprises a first arm and a second arm, wherein the first arm and second arm intersect one another. This exemplary embodiment or another exemplary embodiment may further include that the protrusion extends outwardly from the main body proximate the intersection of the first arm and the second arm. This exemplary embodiment or another exemplary embodiment may further comprising a leg extending outwardly from the main body, wherein the leg is located remote from the intersection of the first arm and the second arm. This exemplary embodiment or another exemplary embodiment may further include that the at least one anchor comprises: a body; a support end provided on the body; and an attachment end provided on the body opposite the support end; wherein the attachment end is removably attachable with the embed grate frame. This exemplary embodiment or another exemplary embodiment may further include that the embed grate frame comprises: a main body; a protrusion extending outwardly from the main body; and wherein the attachment end of the at least one anchor is removably attachable with the protrusion of the embed grate frame. This exemplary embodiment or another exemplary embodiment may further include that the protrusion of the embed grate frame comprises: a stem extending outwardly from the main body, said stem having a first side and a second side; a first flange extending outwardly from the stem; a second flange extending outwardly from the stem; wherein the first flange comprises a first surface and a second surface opposite one another, and wherein the first surface is continuous with the first side of the stem. This exemplary embodiment or another exemplary embodiment may further include that the at least one anchor includes a body with an attachment end, wherein the attachment end is selectively engageable with the protrusion, and wherein the attachment end of the at least one anchor comprises: a first ledge and a second ledge extending outwardly in a same direction from the body; a first side extending between the first ledge and the second ledge; a channel bounded and defined by the first ledge, the first side, and the second ledge; and wherein the channel is adapted to detachably receive a portion of the embed grate frame therein. This exemplary embodiment or another exemplary embodiment may further include that the first ledge of the attachment end engages the first flange of the protrusion and the second ledge of the attachment end engages the second flange of the protrusion. This exemplary embodiment or another exemplary embodiment may further include that the attachment end of the at least one anchor snap-fittingly engages with the protrusion.

BRIEF DESCRIPTION OF THE DRAWINGS

Sample embodiments of the present disclosure are set forth in the following description, are shown in the drawings and are particularly and distinctly pointed out and set forth in the appended claims.

Similar numbers refer to similar parts throughout the drawings.

DETAILED DESCRIPTION

Figure 1:
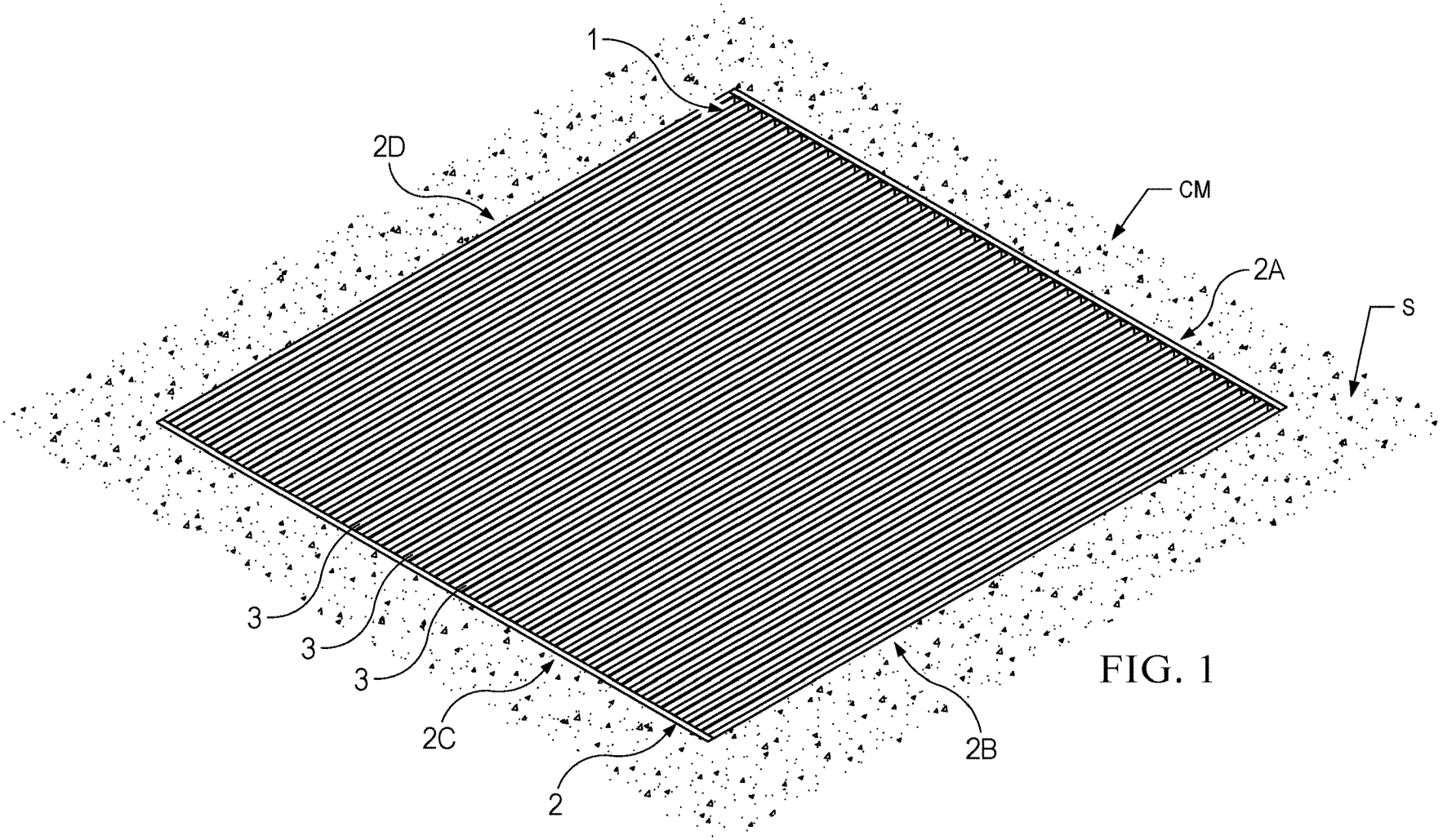
FIG. 1 (FIG. 1) is a front, left, top isometric perspective view of an installed grate frame assembly within a compound material which forms a sidewalk and/or road.

FIG. 1 shows a sidewalk (or road) "S" into which a grate frame assembly 1 has been installed. The grate frame assembly 1 comprises an embed grate frame 2 and a plurality of bearing bars 3 supported by the embed grate frame 2. Embed grate frame 2 includes a first member 2A, a second member 2B, a third member 2C, and a fourth member 2D. First member 2A and third member 2C are opposed to one another and are arranged parallel to one another. Second member 2B and fourth member 2D are opposed to one another and are arranged parallel to one another. Second member 2B and fourth member 2D extend between the ends of first member 2A and third member 2C. Each of the first member 2A, second member 2B, third member 2C, and fourth member 2D is an elongate member that is welded or otherwise secured at it ends to an end of an adjacent member to form an integral component. It will be understood that the overall lengths of first member 2A, second member 2B, third member 2C, and fourth member 2D, will vary based on the desired overall size of grate frame assembly 1. In the embodiment illustrated in FIG. 1, first member 2A and third member 2C will be of the same length as one another and second member 2B and fourth member 2D will be of the same length as one another.

Bearing bars 3 are arranged parallel to one another and are laterally spaced apart. As illustrated, bearing bars 3 extend between second member 2B and fourth member 2D. The ends of bearing bars 3 may be welded to the respective second member 2B and fourth member 2D.

Embed grate frame 2 as illustrated in FIG. 1 is generally square in shape but it will be understood that in other embodiments, embed grate frame 2 may, alternatively, be rectangular in shape or of any other desired shape. Embed grate frame 2 is secured into sidewalk "S" with a compound material "CM" (FIG. 8E), as will be discussed later herein.

Figure 2:
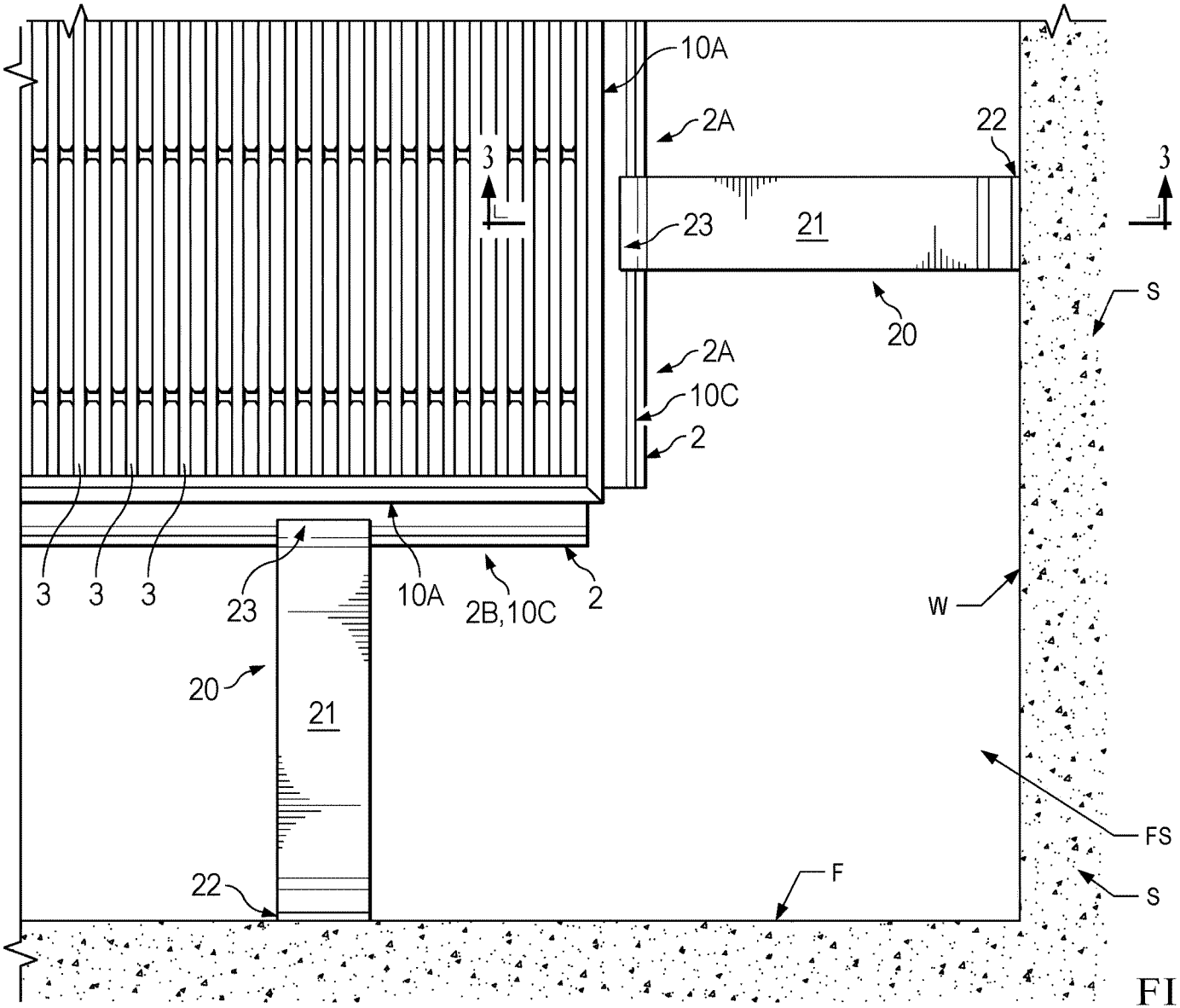
FIG. 2 (FIG. 2) is an enlarged partial top planar view of a first embodiment of an embed grate frame of the grate frame assembly of FIG. 1 in accordance with the present disclosure, wherein the grate frame assembly is shown before compound material is poured to embed the same.
Figure 3:
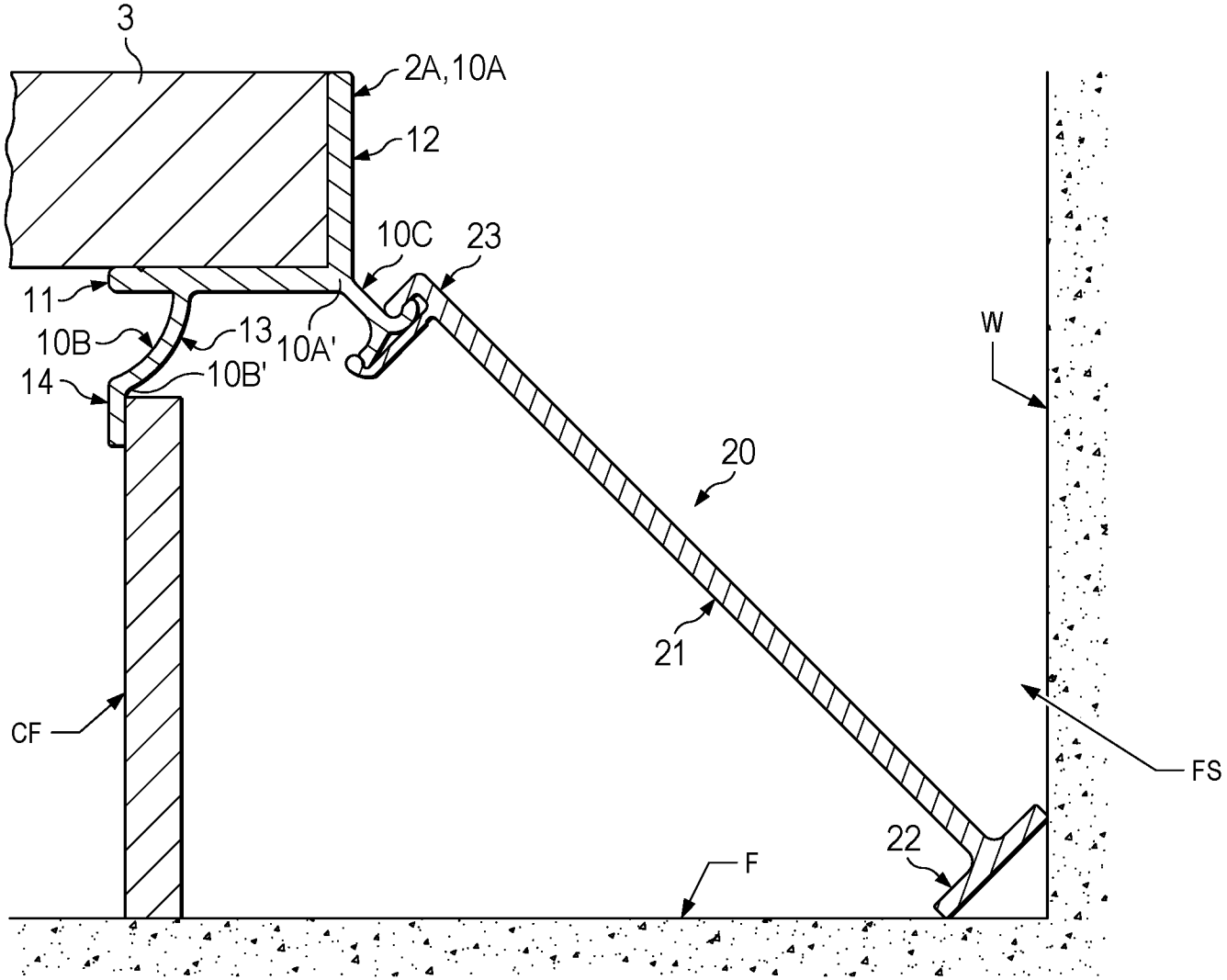
FIG. 3 (FIG. 3) is a cross-section of the grate frame assembly looking in the direction of line 3-3 of FIG. 2.

FIGS. 2 and 3 show an enlarged portion of the grate frame assembly 1 illustrated in FIG. 1. FIGS. 2 and 3 show the grate frame assembly 1 prior to pouring of the compound material "CM" (FIG. 8E) around a portion of the embed grate frame 2 in order to secure embed grate frame 2 into sidewalk "S". A free space "FS" is defined between a wall "W" of the sidewalk "S", a floor "F" of the sidewalk "S", and a concrete form "CF" (FIG. 3) which is placed on floor "F". It will be understood that the term "concrete form" "CF" is representative of any type of formwork or molding that is used in construction. The term "concrete" should not be construed as limiting the type of compound material that is being molded utilizing the concrete form "CF". Grate frame assembly 1 is further shown in these figures to include a plurality of separate anchors 20 which are selectively engaged with the embed grate frame 2. Anchors 20 are used to support embed grate frame 2 in a desired position and orientation within free space "FS" and relative to the wall 'W" and concrete form "CF". As will be discussed later herein, when embed grate frame 2 is properly positioned within free space "FS", compound material "CM" (FIG. 8E) is poured into the free space "FS" in order to securely embed a portion of the embed grate frame 2 and the anchors 20 within sidewalk "S".

The compound material "CM" depicted in FIG. 1 is any suitable material used to construct sidewalk "S" or a road. Suitable materials for use as the compound material "CM" include concrete and asphalt. It should be understood, however, that any compound material which dries and hardens may be used instead of concrete or asphalt. The compound material "CM" may be any concrete or similar material which can achieve the strength necessary for pedestrians and/or vehicles to move across the installed grate frame assembly 1. Additionally, while the grate frame assembly 1 depicted herein is illustrated as being installed within sidewalk "S", the grate frame assembly 1 may instead be installed within a road or in any application where there is a need for a grate to be permanently installed within a compound material.

FIG. 2 shows a corner region of the grate frame assembly 1 and particularly shows a region of first member 2A and second member 2B, with bearing bars 3 arranged parallel to first member 2A and connected to second member 2B. With reference to FIG. 3 there is shown a cross-section of first member 2A supporting a bearing bar 3, wherein the first member 2A is resting on concrete form "CF". FIG. 3 additionally shows one of the plurality of separate anchors 20 operatively engaged with first member 2A.

Figure 4:
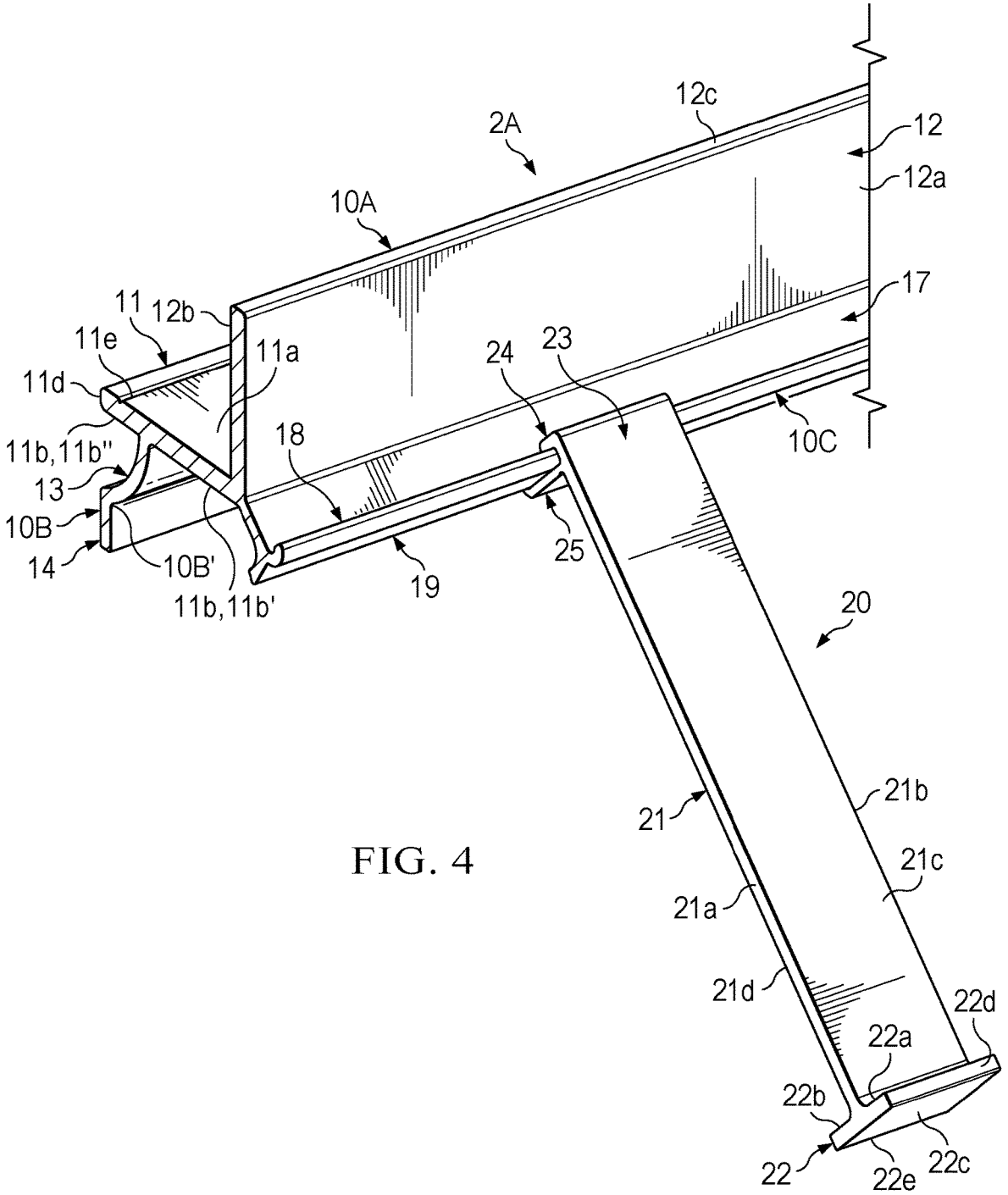
FIG. 4 (FIG. 4) a partial left, top isometric perspective view of the embed grate frame and an anchor of the grate frame assembly shown in isolation.

FIG. 4 shows a portion of first member 2A of the embed grate frame 2 in isolation. It will be understood that the configuration of first member 2A shown in FIG. 4 extends for the entire length of first member 2A between the ends which are proximate second member 2B and fourth member 2D. It will further be understood that each of the first member 2A, the second member 2B, the third member 2C, and the fourth member 2D of embed grate frame 2 is identically configured. Consequently, the following description of first member 2A applies equally to the second member 2B, third member 2C, and fourth member 2D.

Referring to FIGS. 3 and 4, first member 2A comprises a main body 10A, a leg 10B, and a protrusion 10C. Leg 10B and protrusion 10C are integral with main body 10A and extend outwardly therefrom, as will be described later herein.

Main body 10A is generally L-shaped and includes a first arm 11 and a second arm 12 which intersect one another at a corner 10A'. The intersection of the first arm 11 and the second arm 12 is at any angle which will allow bearing bars 3 to be securely set into an area created by the intersection of the first arm 11 and the second arm 12. As illustrated, first arm 11 is orthogonal to second arm 12.

Figure 5:
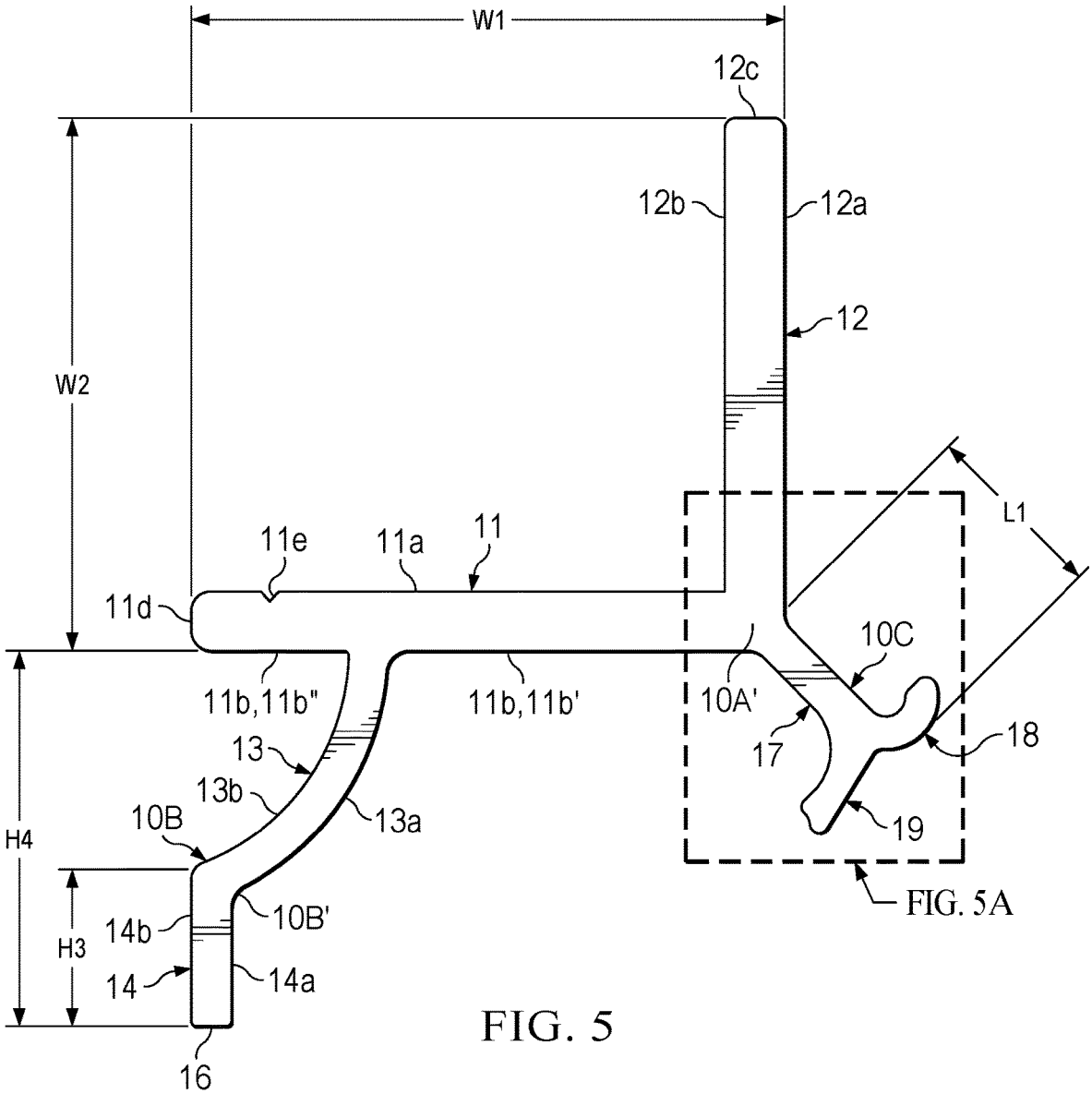
FIG. 5 (FIG. 5) is a left side elevation view of the embed grate frame shown in FIG. 4.
Figure 5A:
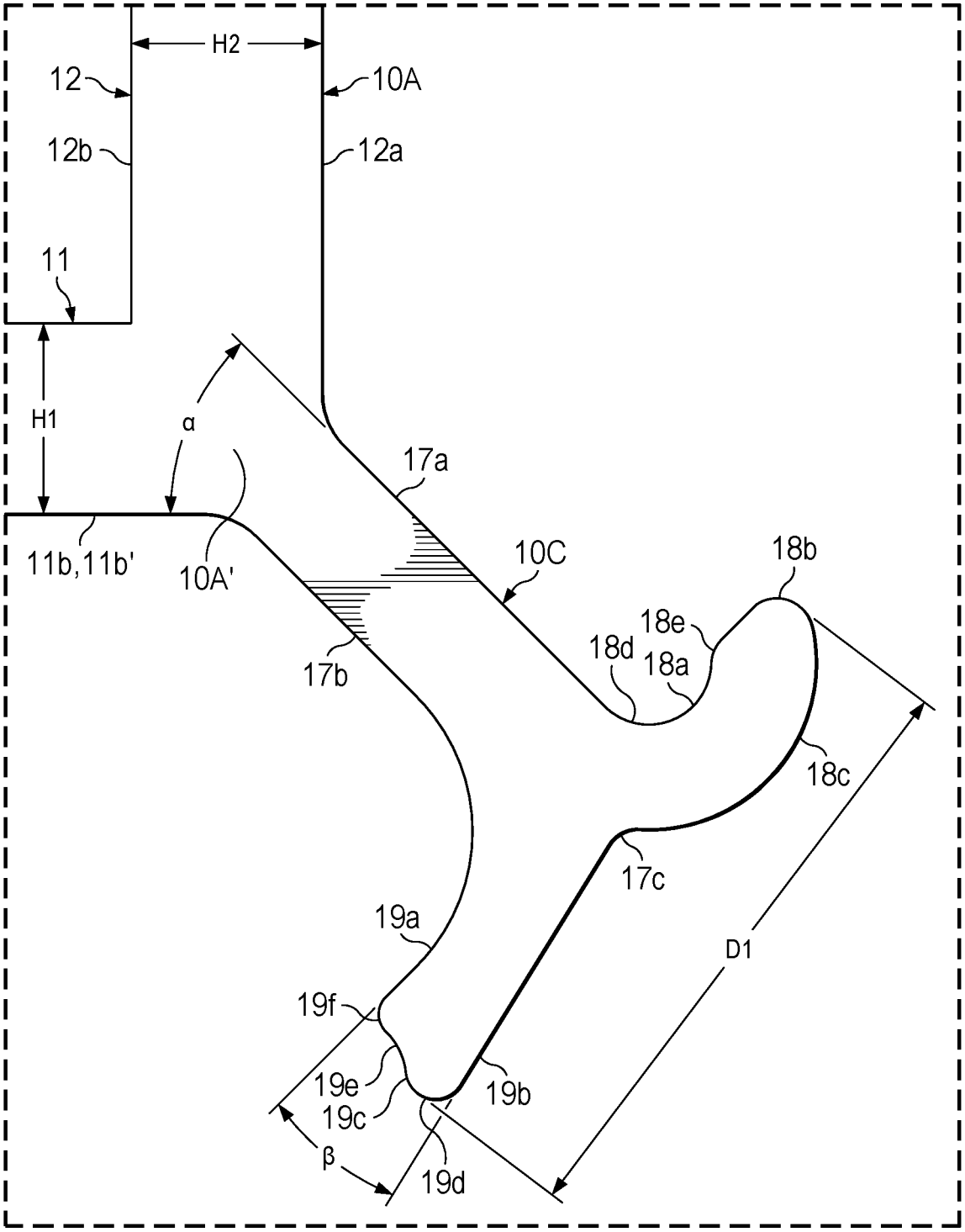
FIG. 5A (FIG. 5A) is an enlarged left side elevation view of the highlighted region of FIG. 5, showing a protrusion of the embed grate frame.
Figure 6:
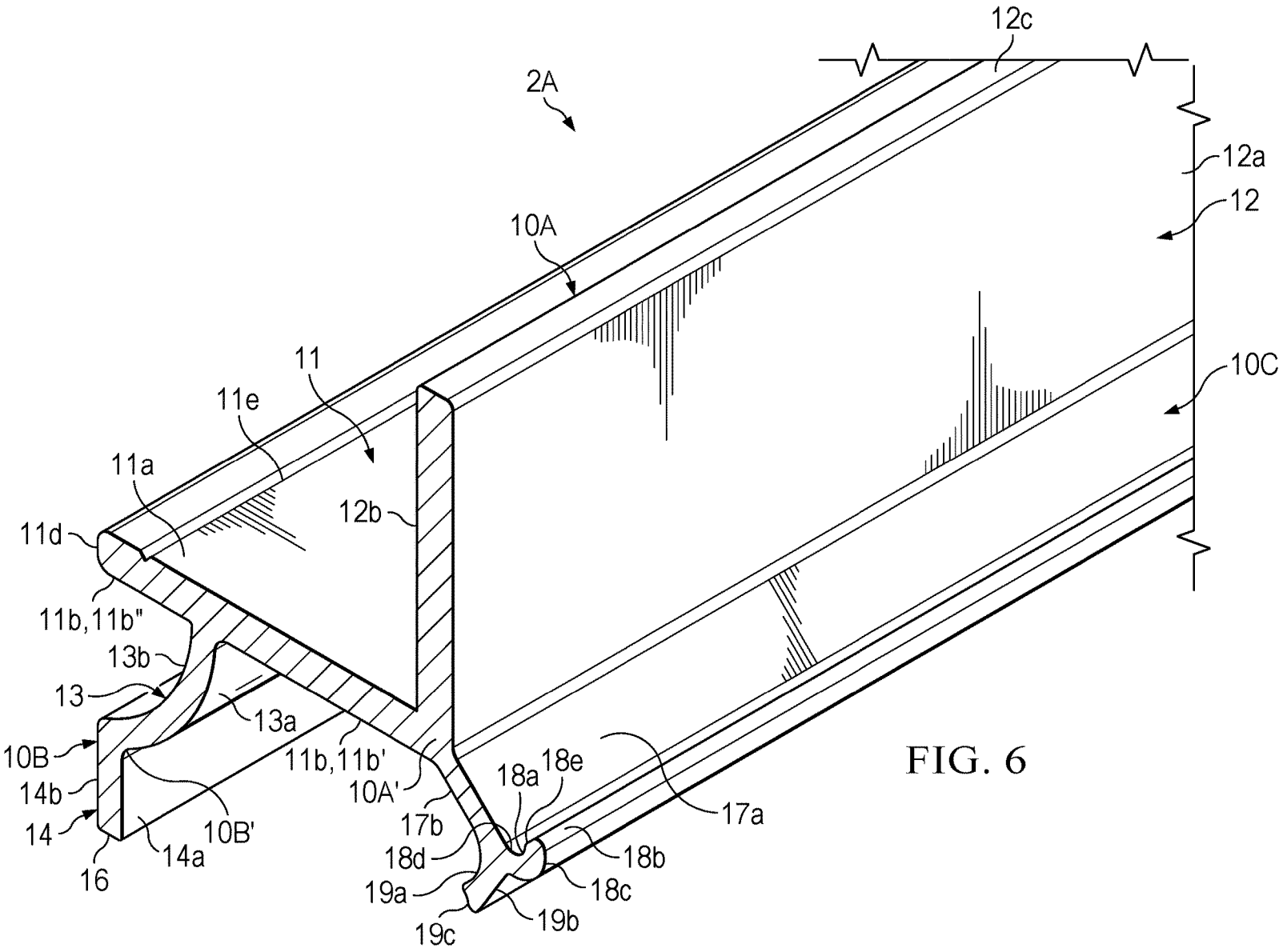
FIG. 6 (FIG. 6) is a partial left, top isometric perspective view of the embed grate frame shown in isolation.

Referring now to FIGS. 5 and 5A, the first arm 11 includes a first side 11*a* opposite to a second side 11*b*. Second side 11*b* includes a first section 11*b*' and a second section 11*b*". First section 11*b*' and second section 11*b*" are substantially aligned with one another. The first section 11*b*' extends from corner 10A' to leg 10B. The second section 11*b*" extends from leg 10B to an end 11*d* of first arm 11. End 11*d* is substantially perpendicular to the first side 11*a* and the second side 11*b* and is the furthest most point on the first arm 11 from the corner 10A'. The end 11*d* is further continuous with the first side 11*a* and the second side 11*b*. The first side 11*a* of the first arm 11 further defines a groove 11*e* therein. Groove 11*e* extends downwardly from the first side 11*a* to the second side 11*b*. As illustrated, the groove 11*e* is located closer to the end 11*d* of first arm 11 than to the corner 10A' of the first arm 11 and the second arm 12. Groove 11*e* extends for substantially the entire length of first member 2A. Groove 11*e* is V-shaped in configuration. In other embodiments, groove 11*e* may be of a different configuration, for example, the groove may be concavely curved. The first arm 11 has a width "W1" measured between the intersection of the first arm 11 and the second arm 12 and the end 11*d*.

In one specific embodiment the first side 11*a* of the first arm 11 may be of a width of about 1-2 inches. Further, the end 11*d* of the first arm 11 may be of a height "H1" of about 0.1-0.3 inches. In the specific embodiment, the groove 11*e* may be located about 0.4-0.6 inches away from the corner 10A'.

Referring still to FIGS. 5 and 5A, the second arm 12 of the main body 10A further includes a first side 12*a* and a second side 12*b* opposite one another. The second arm 12 further includes a first end 12*c* substantially parallel to the first side 11*a* of the first arm 11. The first end 12*c* of the second arm 12 is continuous with the first side 12*a* and the second side 12*b* of the second arm 12 and extends therebetween. The second arm 12 has a width "W2" measured between the intersection of the first arm 11 and the second arm 12 and the first end 12*c*.

In one specific embodiment, the second side 12*b* of the second arm 12 may have a width of about 1-2 inches. Further, the first end 12*c* of the second arm 12 may be of a height "H2" of about 0.1-0.3 inches.

The embed grate frame 2 of the present disclosure may be suitable for any use wherein the main body 10A of the embed grate frame 2 may securely fit a bearing bar 3 which measures about 2 inches or less.

As shown in FIG. 5, leg 10B extends outwardly from first arm 11 of main body 10A. In particular, leg 10B extends outwardly away from second side 11*b* of first arm 11. Leg 10B includes a first region 13 and a second region 14, which intersect one another at a corner 10B'. The first region 10 is of a first configuration and the second region is of a second configuration. The first region 13 is arcuately curved and includes a first surface 13*a* and a second surface 13*b* opposite to one another.

In one specific embodiment, the first region 13 of the leg 10B may have radius of curvature of about 0.25-1 inch.

The first region 13 of the leg 10B is continuous with the second side 11*b* of the first arm 11 of the main body 10A. In particular, the first surface 13*a* of first region 13 is continuous with the first section 11*b*' of second side 11*b*. The second surface 13*b* of the first region 13 of the leg 10B is continuous with the second section 11*b*" of second side 11*b* of first arm 11.

The second region 14 of the leg 10B includes a first side 14*a* and a second side 14*b* opposite to one another, wherein both the first side 14*a* and the second side 14*b* are substantially parallel to the end 11*d* of the first arm 11 of the main body 10A. Second region 14 terminates in an end 16. The end 16 of the leg 10B is continuous with the first side 14*a* and second side 14*b* of the second region 14 of the leg 10B. The end 16 is substantially perpendicular to the first side 14*a* and the second side 14*b*.

The first region 13 and the second region 14 are integral with one another and the first surface 13*a* of the first region 13 and the first side 14*a* of the second region 14 intersect at the corner 10B'. The corner 10B' is at least about 90°. Further, the second region 14 of the leg 10B is substantially aligned with the end 11*d* of the first arm 11 of the main body 10A. More specifically, the second side 14*b* of the second region 14 of the leg 10B is substantially aligned with the end 11*d* of the first arm 11 of the main body 10A.

In one specific embodiment, the second side 14*b* of the second region 14 of the leg 10B may be of a height "H3" (FIG. 5) of about 0.25-0.75 inches. Further, in one embodiment, the height "H4" between the end 16 of the leg 10B and the first side 11*a* of the first arm 11 of the main body 10A is about 1-2 inches.

As shown in FIGS. 3, 5, and 5A, the protrusion 10C extends outwardly away from the corner 10A' of main body 10A. Protrusion 10C includes a stem 17, a first flange 18, and a second flange 19. The protrusion 10C extends outwardly from the main body 10A at the intersection of the second side 11*b* of the first arm 11 and the first side 12*a* of the second arm 12. The protrusion 10C has a length of "L1" (FIG. 5) measured from the intersection of the first arm 11 and the second arm 12 to a terminal end of the protrusion 10C. The length "L1" of the protrusion 10C is less than the height "H4" between the end 16 of the leg 10B and the first side 11*a* of the first arm 11 of the main body 10A, the width "W1" of the first side 11*a* of the first arm 11, and the width "W2" of the second side 12*b* of the second arm 12.

As illustrated in the attached figures, the protrusion 10C is generally T-shaped and comprises a stem 17, a first flange 18, and a second flange 19. The first flange 18 and the second flange 19 extend outwardly from one end of the stem 17 remote from the main body 10A. The stem 17 includes a first side 17*a* (FIG. 5A) and a second side 17*b* opposite to one another, wherein the first side 17*a* is continuous with the first side 12*a* of the second arm 12 of the main body 10A, and the second side 17*b* is continuous with the first section 11*b*' of the second side 11*b* of the first arm 11 of the main body 10A.

Although not illustrated herein, it will be understood that in alternative embodiments, the protrusion 10C could extend outwardly from alternative locations along either the first arm 11 or the second arm 12 of the main body 10A. In these instances, the protrusion 10C could extend from one of the first arm 11 or the second arm 12.

In one specific embodiment, the angle α (FIG. 5A) between the first side 17*a* of the stem 17 of the protrusion 10C and the second side 11*b* of the first arm 11 of the main body 10A is about 40-50°.

The first flange 18 which extends outwardly from one end of stem 17 in a first direction and includes a first surface 18*e* having a first section 18*a* and a second section 18*b* continuous with one another. The first surface 18*e* of the first flange 18 is continuous with first side 17*a* of the stem 17. Specifically, the first section 18*a* of the first surface 18*e* is continuous with the first side 17*a* of the stem 17. The first section 18*a* is curved and the second section 18*b* is substantially flat. The first flange 18 further includes a second surface 18*c* opposite to the first section 18*a* of the first surface. The second surface 18*c* is continuous with the second section 18*b*. The second surface 18*c* of the first flange is curved. The first flange 18 further defines a recess 18*d* formed at the junction of the first side 17*a* of the stem 17 and the first section 18*a* of the first flange 18.

In one specific embodiment, the first section 18*a* of the first surface may have a radius of about 0.04-0.08 inches. Further in this embodiment, the second surface 18*c* may have a radius of about 0.1-0.2 inches. Further, the distance between the radial peaks of the first section 18*a* and the second surface 18*c* is of about 0.10-0.15 inches. Even further, the distance between the radial peak of the second surface 18*c* and the second section 18*b* is of about 0.10-0.15 inches.

The second flange 19 of the protrusion 10C extends outwardly from one end of the stem 17 in a second direction. The second flange 19 is continuous with second side 17*b* of the stem 17. Referring now to FIG. 5A, the second flange 19 includes a first edge 19*a* and a second edge 19*b* opposite to one another, wherein the first edge 19*a* is curved and the second edge 19*b* is substantially straight. The second flange 19 further includes a first end 19*c*, wherein the first end 19*c* is curved. The first end 19*c* is continuous with the first edge 19*a* and the second edge 19*b* and extends therebetween. Further, the first edge 19*a* is continuous with the second side 17*b* of the stem 17. The first edge 19*a* is oriented at an angle β relative to the second edge 19*b*.

Referring now to FIG. 5A, the first end 19*c* of the second flange 19 of the stem 17 further includes a first section 19*d*, a second section 19*e*, and a third section 19*f* which are continuous with one another. The first section 19*d* and the third section 19*f* are convex and the second section 19*e* is concave with respect to the second side 17*b* of the stem 17. Second section 18*b* of the first flange 18 is located a distance "D1" from the first end 19*c* of the second flange 19.

In one specific embodiment, the first end 19*c* may have a height of about 0.05-0.2 inches. The third section 19*f* may have a height of about 0.01-0.05 inches and a radius of about 0.025-0.1 inches. Further in this embodiment, the angle β between the first edge 19*a* and the second edge 19*b* of the second flange 19 is of about 5-25°. Even further in this embodiment, the distance "D1" between the second section 18*b* of the first flange 18 and the first end 19*c* of the second flange 19 is of about 0.25-1 inches.

The first flange 18 and the second flange 19 are integral with one another such that the second surface 18*c* of the first flange 18 is continuous with the second edge 19*b* of the second flange 19. The intersection of second surface 18*c* of the first flange 18 and the second edge 19*b* of the second flange 19 define a channel 17*c*.

Figure 7:
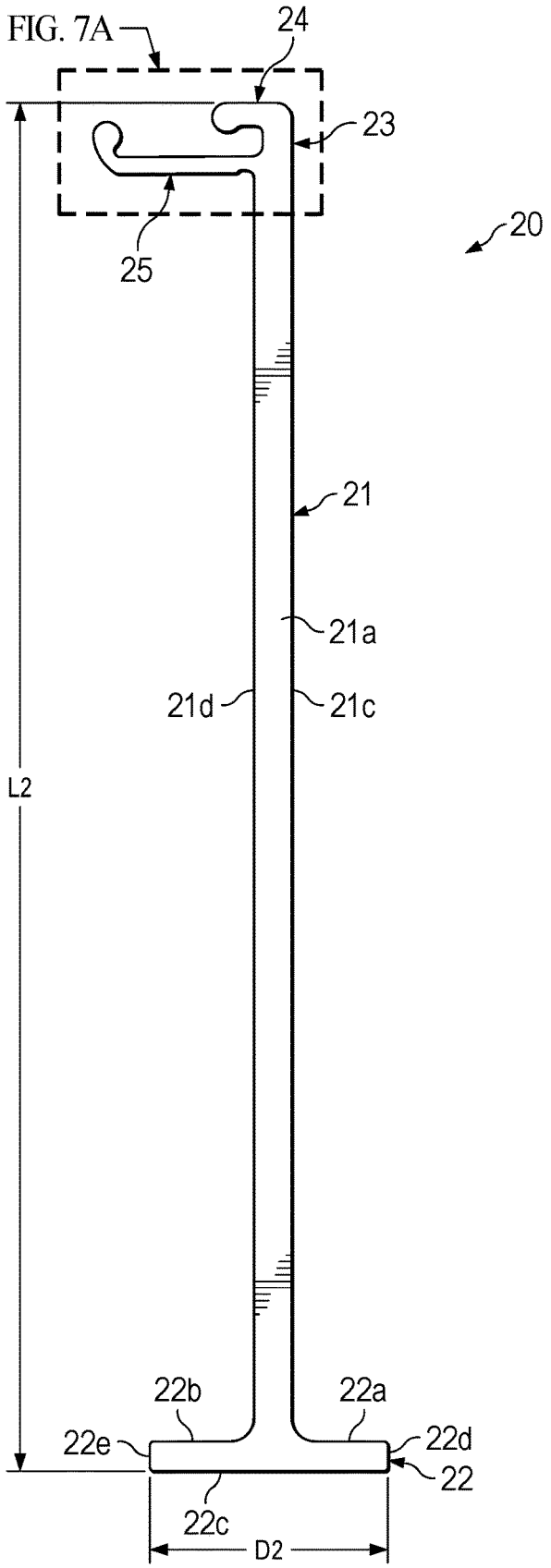
FIG. 7 (FIG. 7) is a left side elevation view of the anchor of the grate frame assembly shown in isolation.
Figure 7A:
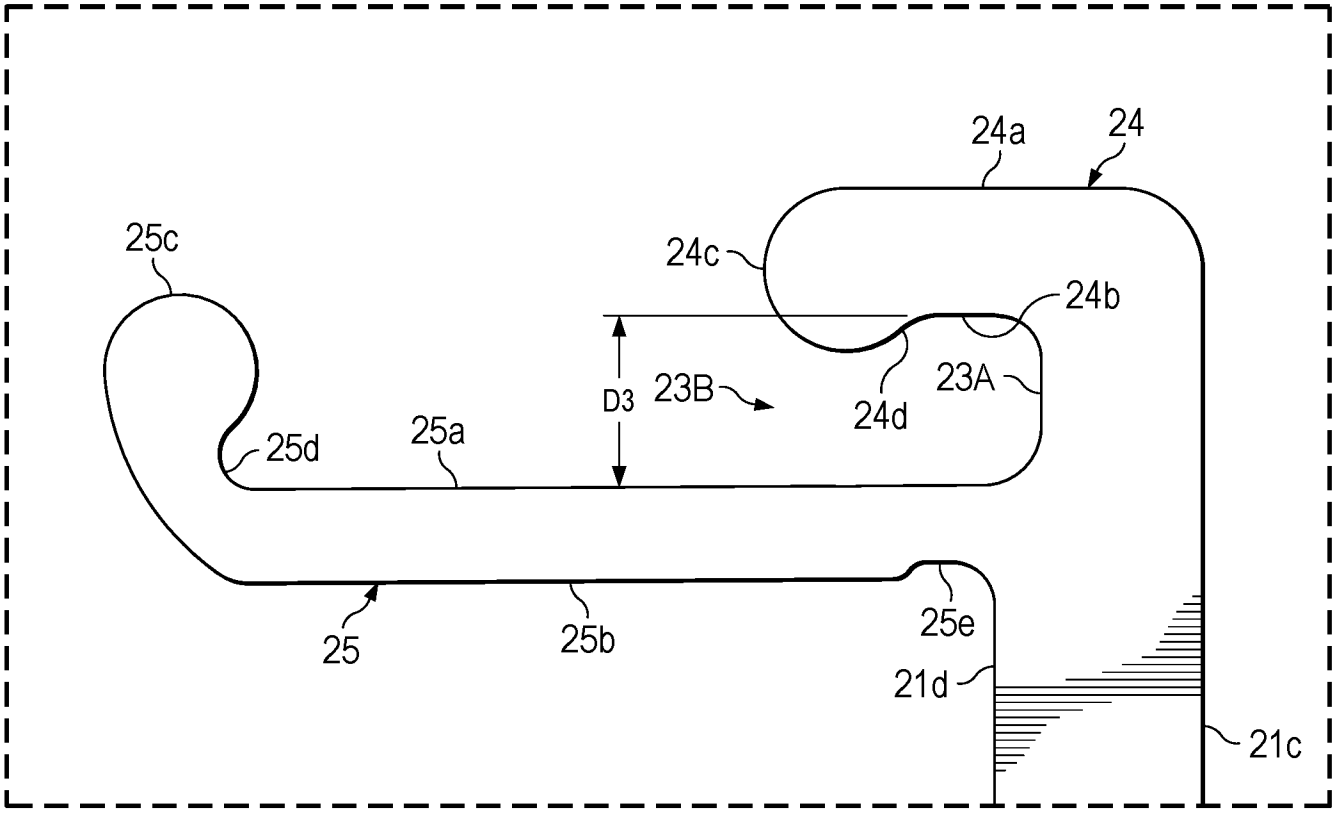
FIG. 7A (FIG. 7A) is an enlarged left side elevation view of the highlighted region of FIG. 7, showing an attachment end of the anchor.

As discussed earlier herein, grate frame assembly 1 includes a plurality of separate anchors 20 which are selectively engaged with embed grate frame 2. Referring now to FIGS. 3, 7 and 7A, each anchor 20 includes a body 21 having a support end 22 and an attachment end 23. The support end 22 is located at an opposite end of the body from the attachment end 23. During installation of the grate frame assembly 1, the support end 22 is configured to engage the wall "W" and floor "F" in the sidewalk "S"", wherein the support end 22 abuts the wall "W" and floor "F" in the sidewalk "S". The attachment end 23 is configured to engage the protrusion 10C of the embed grate frame 2.

Referring now to FIGS. 4, 7, and 7A, the body 21 of the anchor 20 includes a first side 21*a* and a second side 21*b* (FIG. 4) opposite one another. The body 21 of the anchor 20 further includes a first surface 21*c* and a second surface 21*d* opposite to one another. Body 21 of anchor 20 is of a length "L2" (FIG. 7).

In one specific embodiment, the length "L2" of first side 21*a* of the body 21 of the anchor 20 may be about 5-6.5 inches.

Referring now to FIG. 7, the support end 22 includes a first section 22*a* and a second section 22*b* substantially aligned with one another such that body 21 and support end 22, together, are generally T-shaped. The support end 22 includes a third section 22*c* opposite to the first section 22*a* and the second section 22*b*. The support end 22 further includes a first side 22*d* and a second side 22*e* opposite to one another. First side 22*d* and second side 22*e* are located a distance "D2" (FIG. 7) from one another. First side 22*d* and second side 22*e* extend between third section 22*c* and the respective one of first section 22*a* and second section 22*b*.

In one specific embodiment, the width of the third section 22*c* may be of about 0.5-1.5 inches. Further in this embodiment, the length of the first side 22*d* and the second side 22*e* of the support end 22 may be about 0.075-0.175 inches.

The support end 22 and the body 21 are integral with one another such that the first section 22*a* of the support end 22 is continuous with the first surface 21*c* of the body 21 and the second section 22*b* of the support end 22 is continuous with the second surface 21*d* of the body 21.

Referring to FIG. 7A, the attachment end 23 of the anchor 20 includes a first ledge 24 and a second ledge 25 located opposite one another and extending outwardly from the body 21. Attachment end 23 further includes a first side 23A which defines the distance "D3" between the first ledge 24 and the second ledge 25. A channel 23B is defined between the first ledge 24 and the second ledge 25. The first ledge 24 extends further outwardly from the first side 23A of the attachment end 23 than the second ledge 25.

The first ledge 24 includes a first surface 24*a* and a second surface 24*b* opposite to one another. The first surface 24*a* of the first ledge 24 is continuous with the first surface 21*c* of the body 21 of the anchor 20. Further, the second surface 24*b* of the first ledge 24 is continuous with the first side 23A of the attachment end 23. The first ledge 24 further includes a first end 24*c* opposite to the first surface 21*c* of the body 21 of the anchor 20. The first ledge 24 defines a slot 24*d* at the intersection of the second surface 24*b* and the first end 24*c*. As illustrated in the figures, the first end 24*c* of the first ledge 24 of the anchor 20 is enlarged relative to the rest of the first ledge 24.

In another embodiment, the first end 24*c* may be convex with respect to the first surface 21*c* of the body 21 of the anchor 20. In yet another embodiment, the first end 24*c* may be a convex bulb with respect to the first surface 21*c* of the body 21 of the anchor 20. In yet another embodiment, the first end 24*c* may be bulbous with respect to the first surface 21*c* of the body 21 of the anchor 20. In one specific embodiment, the radius of first end 24*c* may be of about 0.075-0.175 inches.

Referring still to FIG. 7A, the second ledge 25 of the attachment end 23 includes a first surface 25*a* and a second surface 25*b* opposite to one another. The second ledge 25 further includes a first end 25*c* opposite the first surface 21*c* of the body 21 of the anchor 20. The second ledge 25 defines a passage 25*d* at the intersection of the first surface 25*a* and the first end 25*c*. Further, the first surface 25*a* of the second ledge 25 is continuous with the first side 23A of the attachment end 23.

The second ledge 25 further defines an inset 25*e* between the second surface 25*b* of the second ledge 25 and the second surface 21*d* of the body 21, and extending upwardly towards the first surface 25*a* of the second ledge 25. Because of the presence of inset 25*e*, second ledge 25 is thinner proximate body 21 than remote from body 21. Second ledge 25 may therefore be able to flex somewhat relative to body 21. The first end 25*c* of the second ledge 25 is enlarged relative to the rest of the second ledge 25.

In another embodiment, the first end 25*c* of the second ledge 25 may be convex with respect to the first side 23A of the attachment end 23. In yet another embodiment, the first end 25*c* may be a convex hook with respect to the first side 23A of the attachment end 23. In yet another embodiment, the first end 25*c* may be hooked with respect to the first side 23A of the attachment end 23. In this other embodiment, the length of the convex hook is of a length of about 0.1-0.4 inches. Further in this embodiment, the length between the first side 23A of the attachment end 23 and the passage 25*d* of the second ledge 25 is about 0.5-0.8 inches. Even further in this embodiment, the distance between the first end of 24*c* of the first ledge 24 and the first end 25*c* of the second ledge 25 is of about 0.25-0.6 inches.

The attachment end 23 of the anchor 20 is configured to detachably engage and is complementary to the protrusion 10C of the embed grate frame 2. Moreover, the attachment end 23 is selectively engageable with the protrusion 10C.

Having now described the embed grate frame 2 and the anchor 20 of grate frame assembly 1, a method of installing the grate frame assembly 1 at a worksite will now be described in greater detail. Embed grate frame 2 and a plurality of separate anchors 20 will be shipped to the worksite separately. The plurality of separate anchors 20 will then be engaged with the embed grate frame 2 at the worksite. Shipping these components separately helps to ensure that there is less opportunity for damage to the components before installation and also reduces shipping costs because the embed grate frame 2 occupies less space. The engagement of one anchor 20 of the plurality of anchors 20 with the embed grate frame 2 to form the grate frame assembly 1 will now be described in more detail below.

Figure 8A:
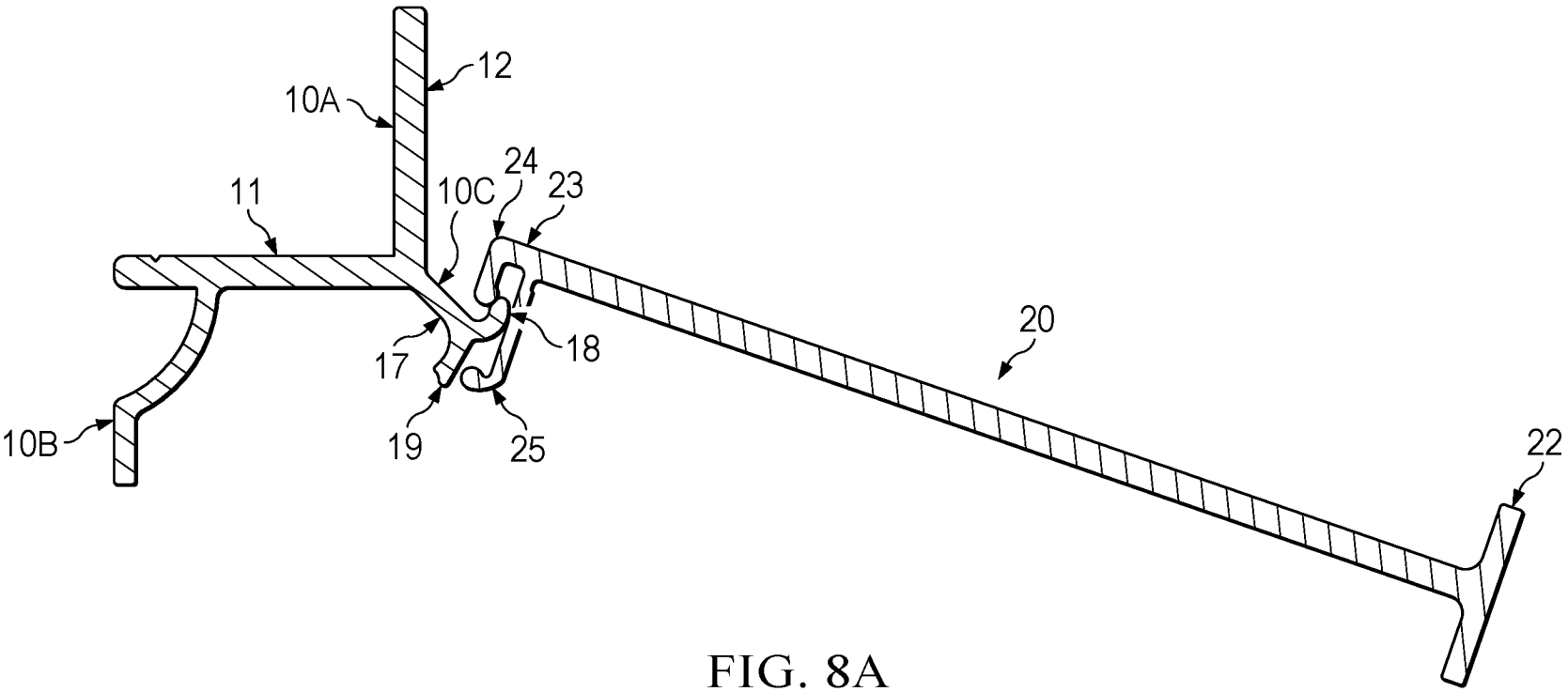
FIG. 8A (FIG. 8A) is a cross section of the grate frame assembly taken at line 3-3 of FIG. 2, showing the anchor being operably engaged with the protrusion of the embed grate frame.

Referring now to FIG. 8A, the anchor 20 removably attached to the embed grate frame 2. More specifically, the attachment end 23 of the anchor 20 removably attached to the protrusion 10C of the embed grate frame 2.

Figure 8B:
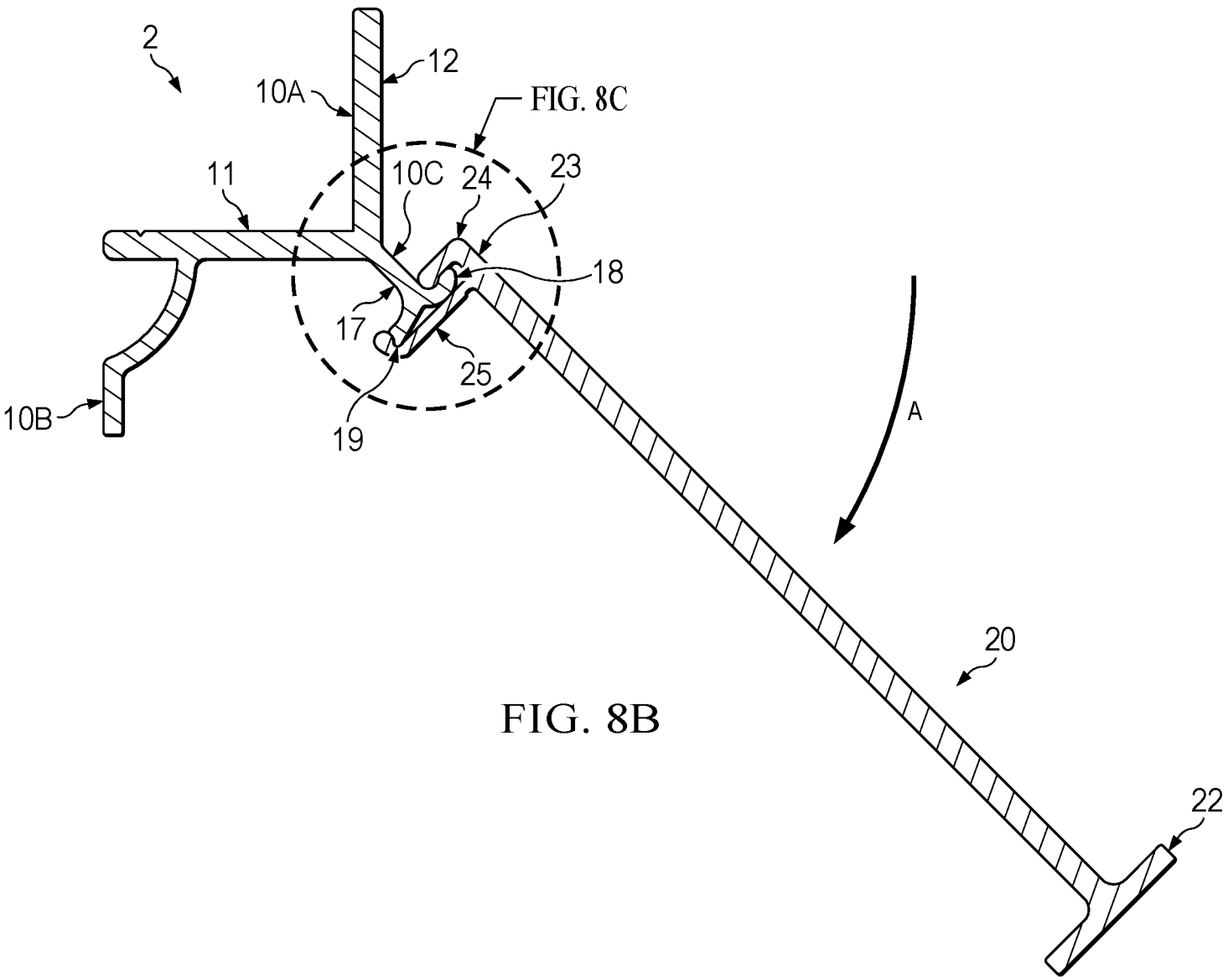
FIG. 8B (FIG. 8B) is a cross section of the grate frame assembly taken at line 3-3 of FIG. 2, showing the anchor installed onto the embed grate frame.

The user may introduce the anchor 20 to the embed grate frame 2 by placing the first ledge 24 of the attachment end 23 of the anchor 20 atop the first flange 18 of the protrusion 10C of the main body 10A wherein the first flange 18 of the protrusion 10C is in the channel 23B of the attachment end 23. Referring now to FIG. 8B, once the first ledge 24 of the attachment end 23 is positioned, the user may press on the anchor in an arch motion away from the main body 10A of the embed grate frame 2 also depicted as arrow "A" on FIG. 8B to secure the attachment end 23 of the anchor 20 to the protrusion 10C of the embed grate frame 2. In particular, anchor 20 is snap-fittingly engaged with protrusion 10C.

Figure 8C:
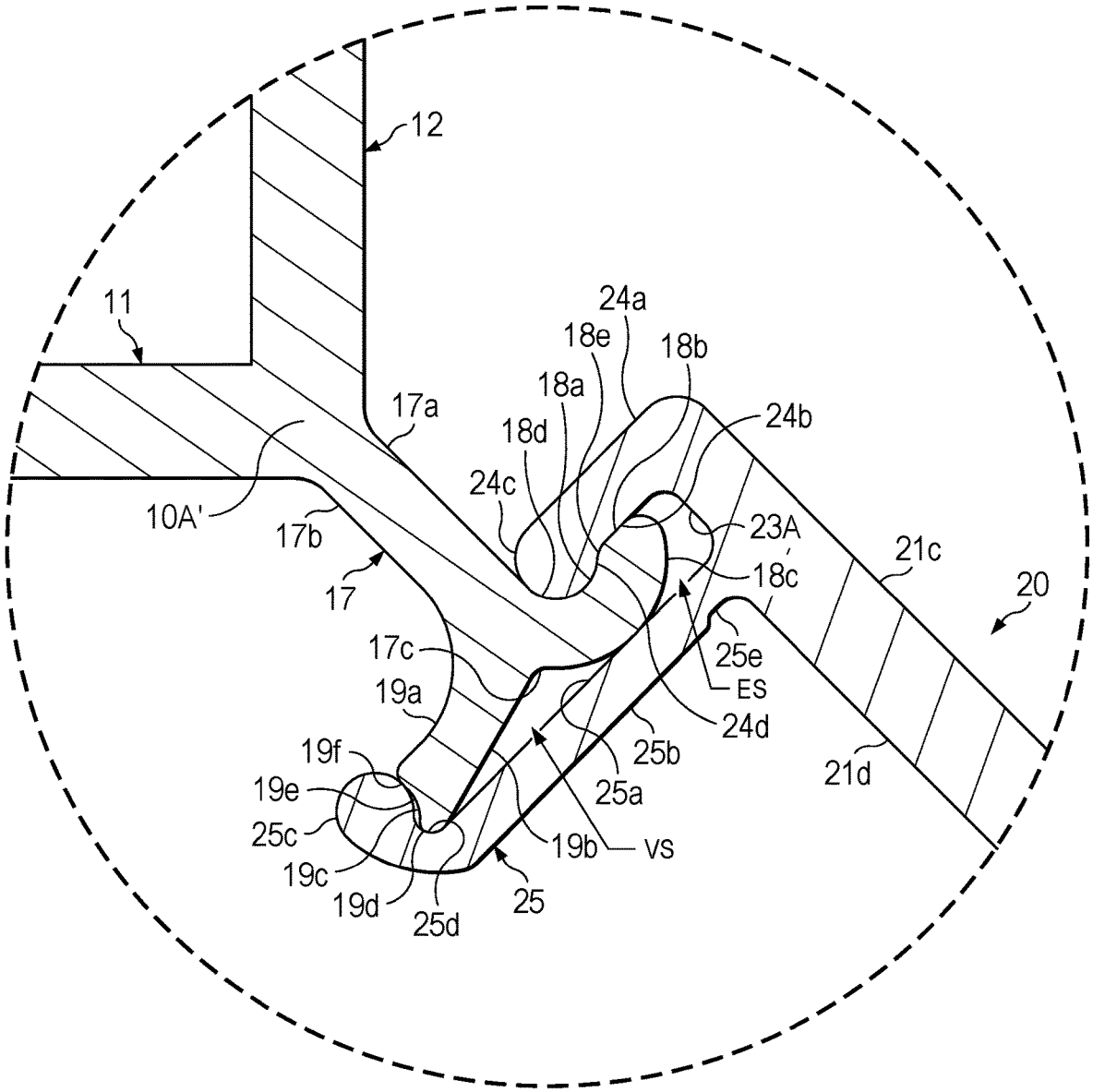
FIG. 8C (FIG. 8C) is an enlarged cross-sectional view of the highlighted region of FIG. 8B, showing the connection between the attachment end of the anchor and the protrusion of the embed grate frame.

Referring now to FIG. 8C, once the attachment end 23 of the anchor 20 is snap-fittingly secured onto the protrusion 10C of the embed grate frame 2, the following depicts the relationship between the attachment end 23 of anchor 20 and the protrusion 10C.

The first flange 18 of the protrusion 10C of the embed grate frame 2 is operably engaged with attachment end 23 of the anchor 20. Specifically, the first section 18*a* of the first flange 18 of the protrusion 10C is contiguous with the first end 24*c* of the first ledge 24 of the attachment end 23, wherein the recess 18*d* of the first flange 18 of the protrusion 10C is contiguous with the first end 24*c* of the first ledge 24 of the attachment end 23 of the anchor 20. The second section 18*b* of the first flange 18 of the protrusion 10C is contiguous with the second surface 24*b* of the first ledge 24 of the attachment end 23. The junction between the first section 18*a* and the second section 18*b* of the first flange 18 of the protrusion 10C is contiguous with the slot 24*d* of the first ledge 24 of the attachment end 23. Further, the peak of the second surface 18*c* of the first flange 18 of the protrusion 10C is contiguous with the first surface 25*a* of the second ledge 25 of the attachment end 23, wherein there is empty space "ES" (FIG. 8C) between second surface 18*c* of the first flange 18 of the protrusion 10C and the first side 23A of the attachment end 23.

Further, the second flange 19 of the protrusion 10C of the embed grate frame 2 is operably engaged with the second ledge 25 of the attachment end 23 of the anchor 20. The first end 19*c* of the second flange 19 of the protrusion 10C is contiguous with the first end 25*c* of the second ledge 25 of the attachment end 23. More specifically, the first section 19*d* of the first end 19*c* is contiguous with the passage 25*d* of the second ledge 25 of the attachment end 23. The second section 19*e* and the third section 19*f* of the first end 19*c* of the second flange 19 of the protrusion 10C is contiguous with the first end 25*c* of the second ledge 25 of the attachment end 23.

Further, when the protrusion 10C and the attachment end 23 are operably engaged, there is void space "VS" (FIG. 8C) extending from the first surface 25*a* of the second ledge 25 to the second edge 19*b* of the second flange 19 and between the channel 17*c* of the protrusion 10C and the first surface 25*a* of the second ledge 25 of the attachment end 23.

Having now described the engagement between the embed grate frame 2 and the anchor 20 to form the grate frame assembly 1, a method for installing the grate frame assembly 1 into a worksite will now be described.

Figure 8D:
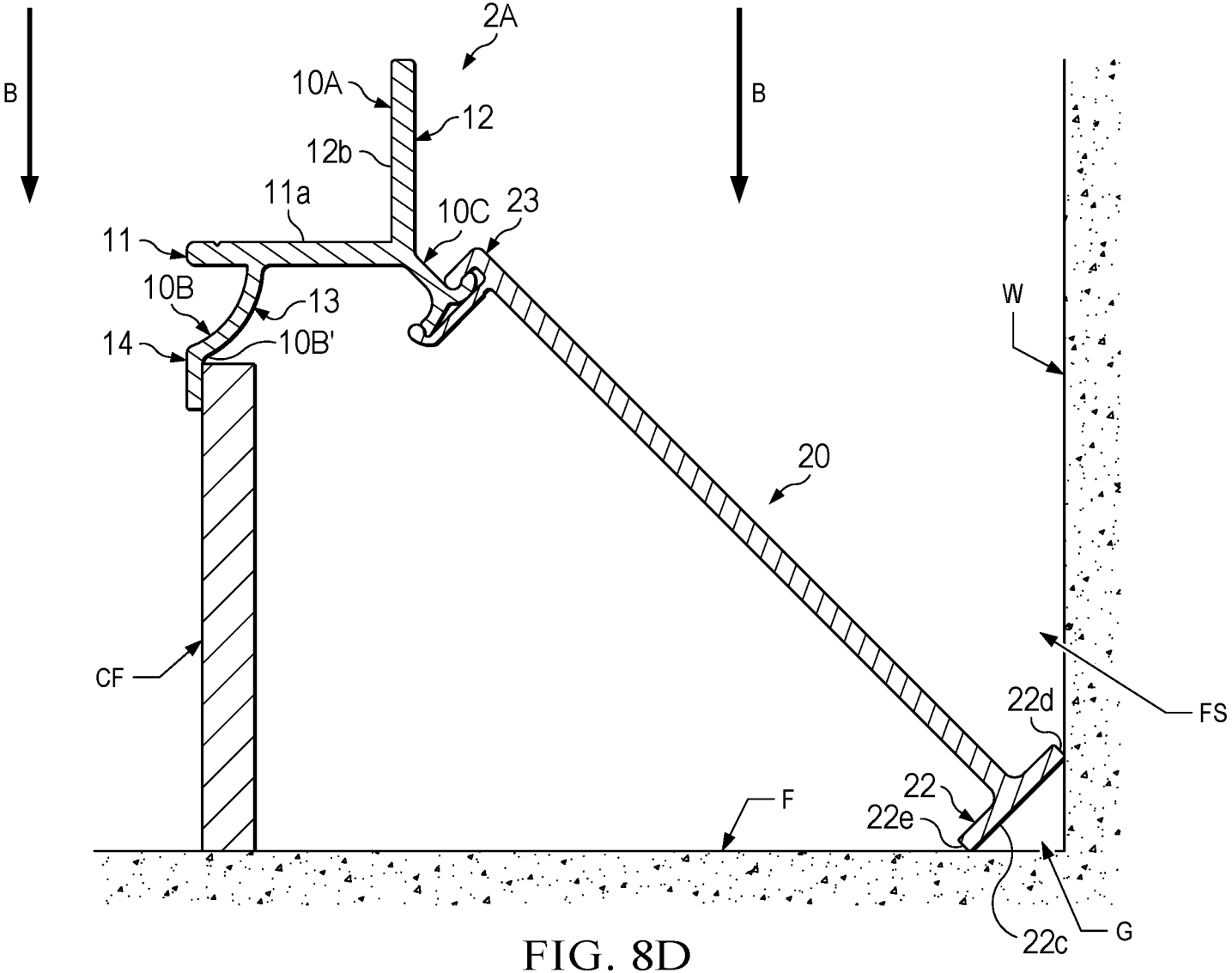
FIG. 8D (FIG. 8D) is a cross section of the grate frame assembly taken at line 3-3 of FIG. 2, showing the embed grate frame being lowered into place atop a concrete form and spaced from a wall.

Referring now to FIG. 8D, the user lowers the grate frame assembly 1 into the worksite. In particular, the worksite comprises a sidewalk "S" (FIG. 1) in which an opening has been defined. At least a portion of the opening is bounded and defined by the wall "W". Concrete form "CF" is placed a distance away from wall "W" such that free space "FS" is defined between wall "W" and concrete form "CF". It will be understood that if a square or rectangular grate frame assembly 1 is to be installed in sidewalk "S", then the wall "W" defining the opening will be generally square or rectangular in configuration. Furthermore, the concrete form "CF" utilized to support the entire grate frame assembly 1 will similarly be square or rectangular in configuration.

When concrete form "CF" is in place, embed grate frame 2 is lowered into position such that leg 10B of embed grate frame 2 rests upon concrete form "CF" as will be discussed hereafter. It will be understood that anchors 20 may be engaged with embed grate frame 2 before embed grate frame 2 is lowered into the free space "FS" or after embed grate frame 2 is lowered into free space "FS" and/or seated on concrete form "CF". The lowering of the embed grate frame 2 is depicted in FIG. 8D by arrows "B". More specifically, the second region 14 of the leg 10B is configured to engage the concrete form "CF". Even more specifically, the leg 10B is configured to engage an uppermost end of the concrete form "CF". Particularly, the corner 10B' of the leg 10B is configured to engage an uppermost end of the concrete form "CF" at the part of the concrete form "CF" furthest from the wall "W". The first region 13 of leg 10B curves away from protrusion 10C and the corner 10B' of leg 10B engages the uppermost corner of the concrete form "CF" that is located furthest from wall "W". Once the leg 10C is placed atop the concrete form "CF" the main body 10B of the embed grate frame 2 is positioned where the main body 10B does not touch the concrete form "CF".

In one specific embodiment, the leg of the embed grate frame may be differently configured from what is illustrated in the attached figures. For example, a first region of the leg may curve towards the protrusion and the corner between the first region and the second region may receive the uppermost corner of the concrete form "CF" which is closest to the wall "W". In other embodiments, the leg may be of any configuration that can engage concrete form "CF" and help retain embed grate frame 2 in place within the free space "FS".

Further, when the user lowers the grate frame assembly 1 into the worksite, the anchor 20 is configured to engage wall "W". More specifically, the support end 22 of the anchor 20 is configured to engage wall "W". Even more specifically, the junction between the first side 22*d* and the third section 22*c* of support end 22 contacts wall "W" and the junction between the second side 22*e* and the third section 22*c* of support end 22 contacts floor "F". When the anchor 20 is engaged with the wall "W" and floor "F", there is gap "G" between the wall "W" and the third section 22*c* of the support end 22 of the anchor 20.

Figure 8E:
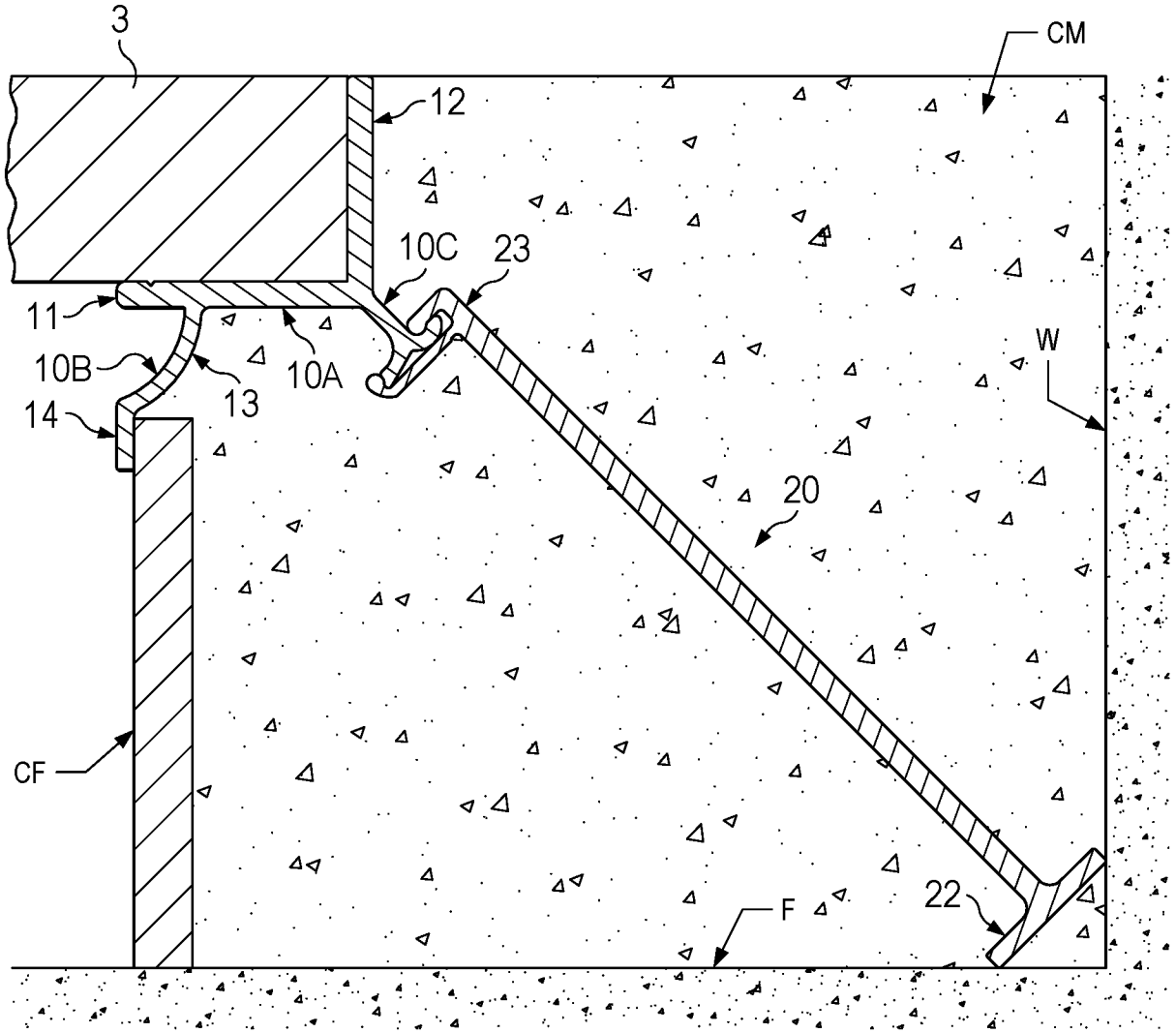
FIG. 8E (FIG. 8E) is a cross section of the grate frame assembly taken at line 3-3 of FIG. 2, showing a free space between the wall and the concrete form filled with the compound material.

The user fills the free space "FS" with compound material" CM". Either before or after the compound material "CM" sets, i.e., dries and hardens, the user engages the bearing bars 3 with embed grate frame 2. Specifically, the first arm 11 and the second arm 12 of the main body 10A of the embed grate frame 2 is configured to receive the bearing bars 3 of the embed grate frame 2. Even more specifically, a lowermost region of the ends of the bearing bars 3 are seated on first side 11*a* of the first arm 11 and abut the second side 12*b* of the second arm 12. The bearing bars 3 may be welded or otherwise secured to embed grate frame 2. (It will be understood that in other embodiments, not illustrated herein, bearing bars 3 may simply rest upon first arm 11.) FIG. 8E shows the embed grate frame 2 and anchor 20 secured in place by compound material "CM" and bearing bars 3 engaged with embed grate frame 2.

FIGS. 9-12 illustrate a second embodiment of an embed grate frame 102. The anchor 20 described previously herein is adapted to be engaged with either of the embed grate frame 2 or the embed grate frame 102 and therefore will not be described in any further detail herein. It should be understood that embed grate frame 102 includes a first member 2A', a second member, a third member, and a fourth member similar to embed grate frame 2 which includes first member 2A, second member 2B, third member 2C, and fourth member 2D. Each of the first member 2A', the second member, the third member, and the fourth member of embed grate frame are identical in configuration to one another but are differently configured relative to the members 2A, 2B, 2C, and 2D First member 2A' of embed grate frame 102 comprises a main body 110A, a leg 110B, and a protrusion 110C. Main body 110A comprises a first arm 111 and a second arm 112. First member 2A' of embed grate frame 102 is identical in structure and function to first member 2A of embed grate frame 2 first embodiment of the embed grate frame in all aspects except with respect to the configuration of the second arm 112. In view of this, the following discussion relates substantially entirely to the structure and function of second arm 112.

Figure 10:
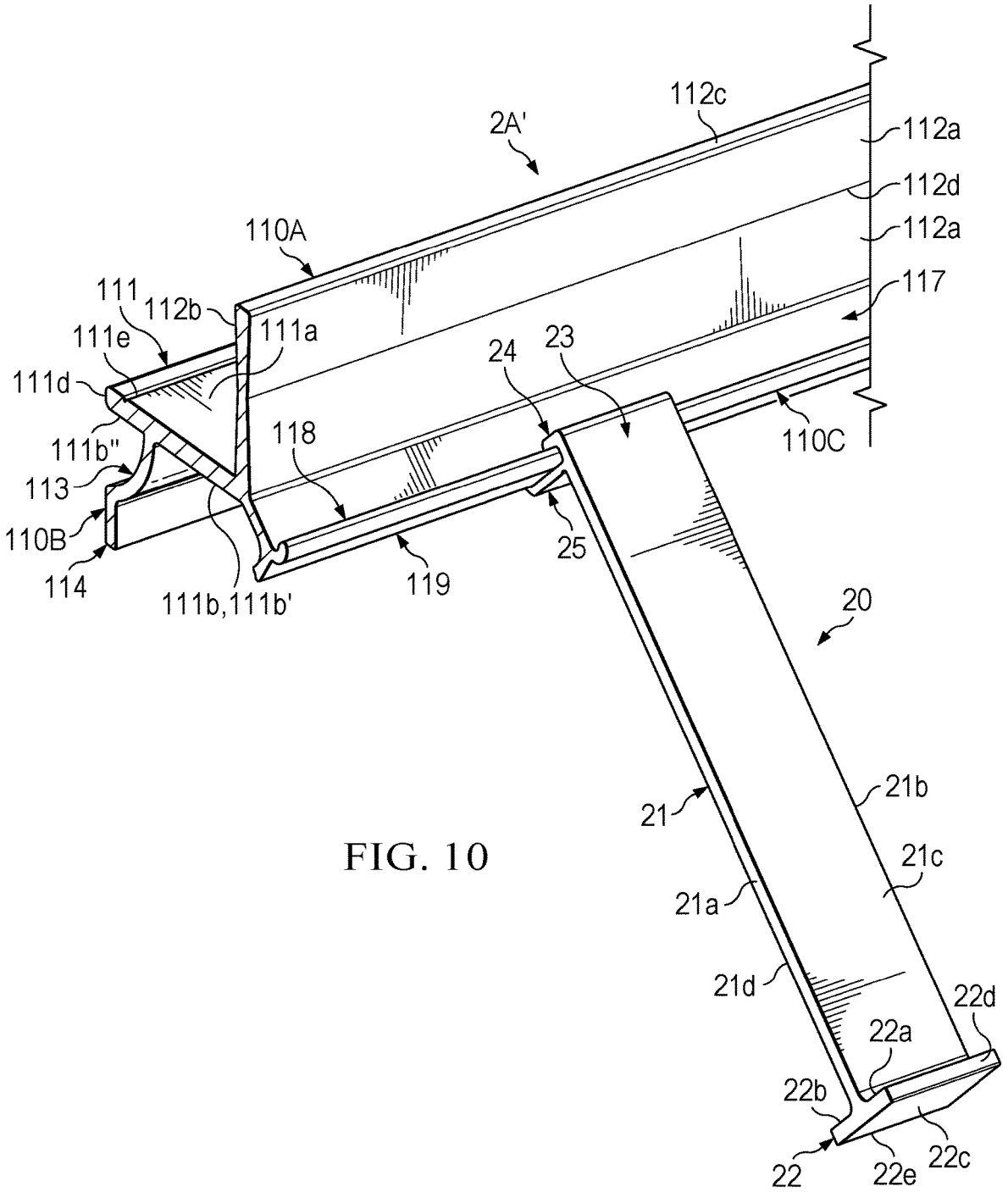
FIG. 10 (FIG. 10) a partial left, top isometric perspective view of the embed grate frame of FIG. 9, shown in isolation with the anchor of the grate frame assembly engaged therewith.
Figure 11:
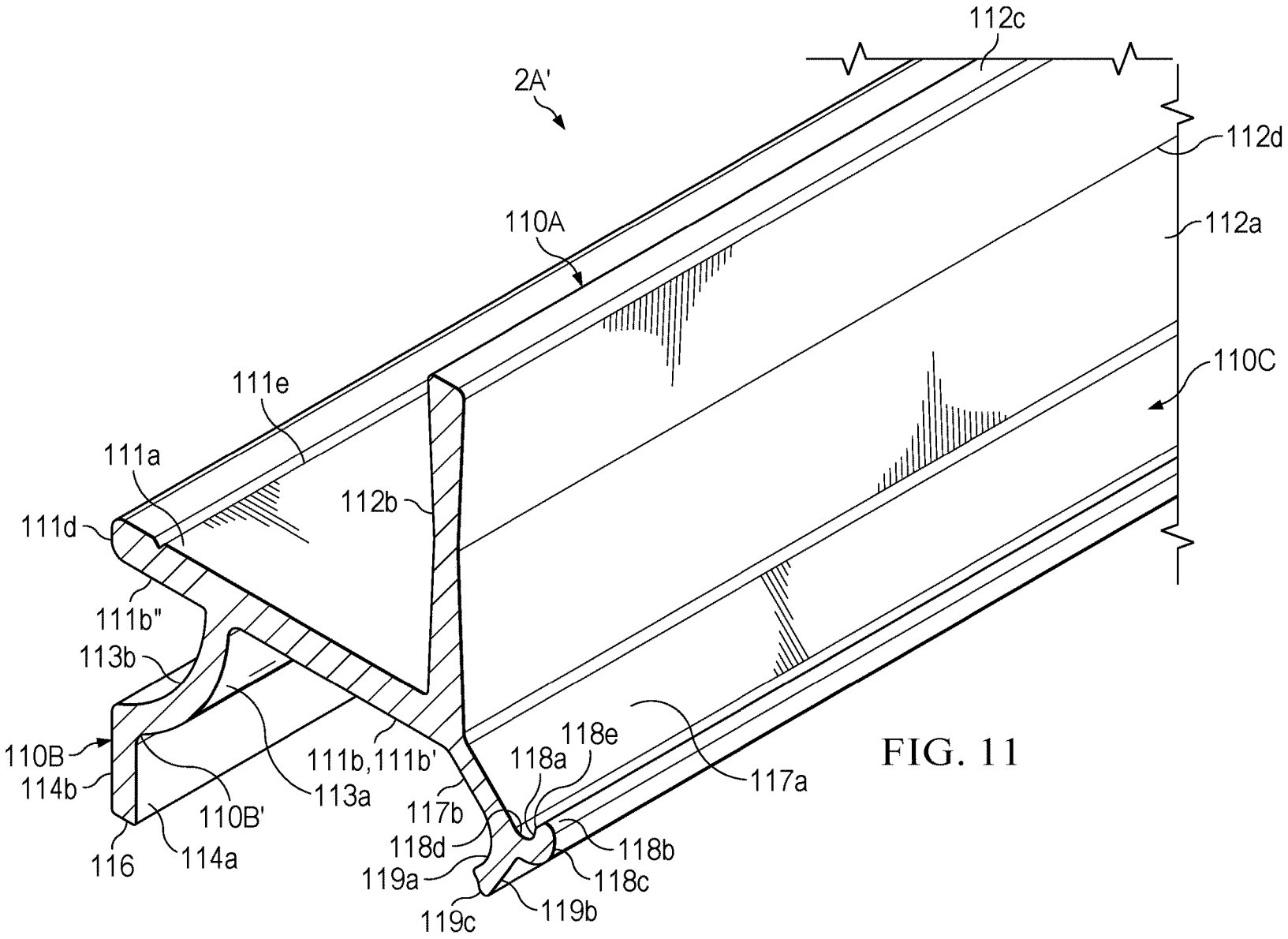
FIG. 11 (FIG. 11) is a partial left, top isometric perspective view of the embed grate frame of FIG. 10 shown in isolation.

Referring now to FIGS. 10 and 11, the second arm 112 of the main body 110A includes a first side 112*a* and a second side 112*b* opposite one another. The second arm 112 further includes a first end 112*c* which extends between first side 112*a* and second side 112*b*. First end 112*c* is substantially parallel to the first side 111*a* of the first arm 111. The first end 112*c* of the second arm 112 is continuous with the first side 112*a* and the second side 112*b* of the second arm 112.

Figure 12:
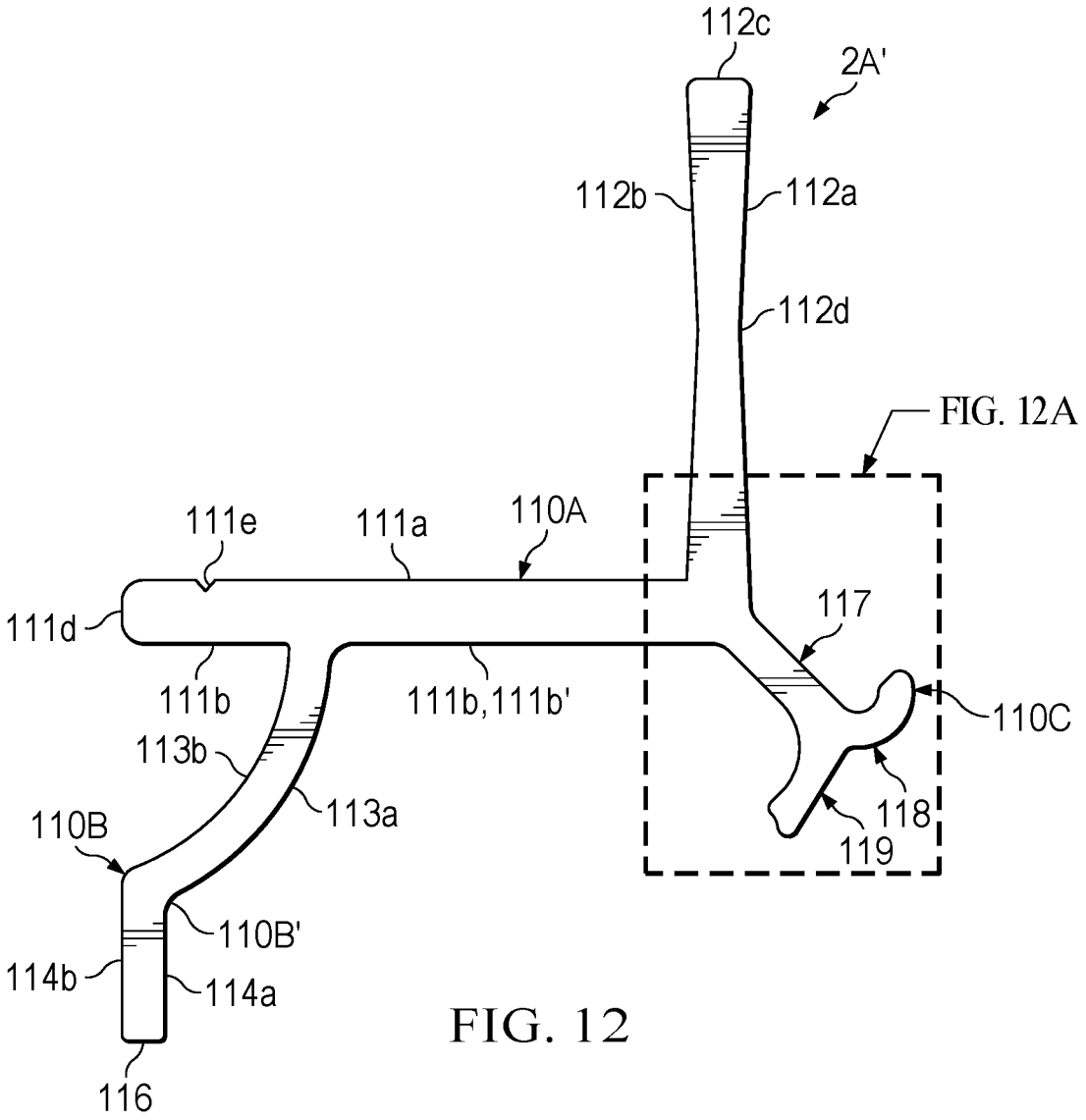
FIG. 12 (FIG. 12) is a left side elevation view of the embed grate frame of FIG. 10.
Figure 12A:
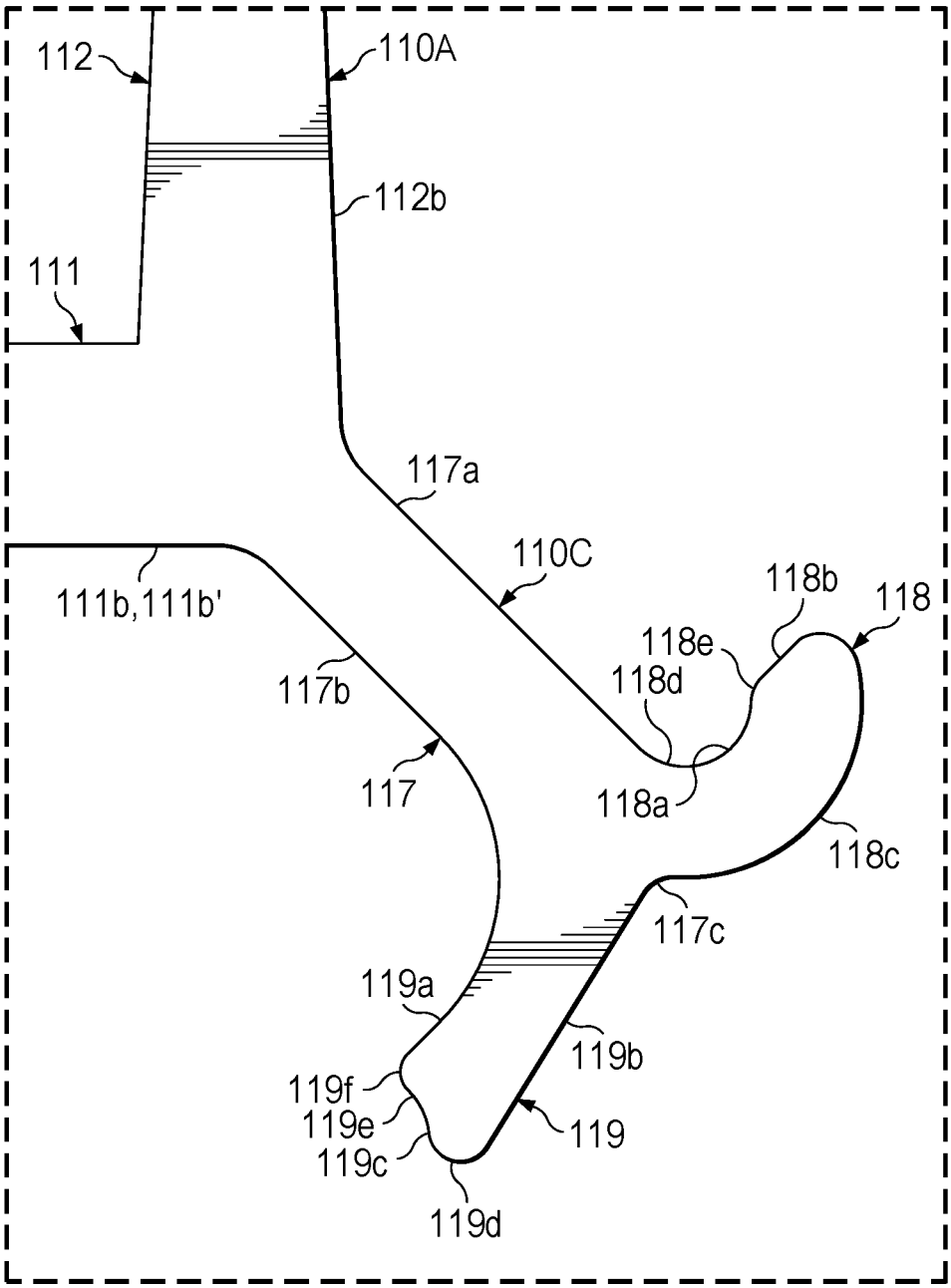
FIG. 12A (FIG. 12A) is an enlarged left side elevation view of the highlighted region of FIG. 12, showing the protrusion of the embed grate frame.

Referring now to FIGS. 12 and 12A the second arm 112 of the main body 110A may be generally an hourglass shape wherein the first side 112*a* and the second side 112*b* have a curve or are angled with respect to the first end 112*c*. The first side 112*a* and the second side 112*b* have wider portions at the top further from the first arm 111 and the end closer to the first arm 111 and narrow to a thinner portion 112*d* at around the middle of the second arm 112. The thinner portion 112*d* may be of a thickness around 0.05-0.25 inches.

In one specific embodiment, the second side 112*b* of the second arm 112 may be of a width, similar to width "W2" (FIG. 5), of about 1-2 inches. Further, the first end 112*c* of the second arm 112 may be of a height, similar to height "H2" (FIG. 5A) of about 0.1-0.3 inches. In yet another embodiment, the first side 112*a*, and the second side 112*b* of second arm 112 may have some curvature.

Figure 9:
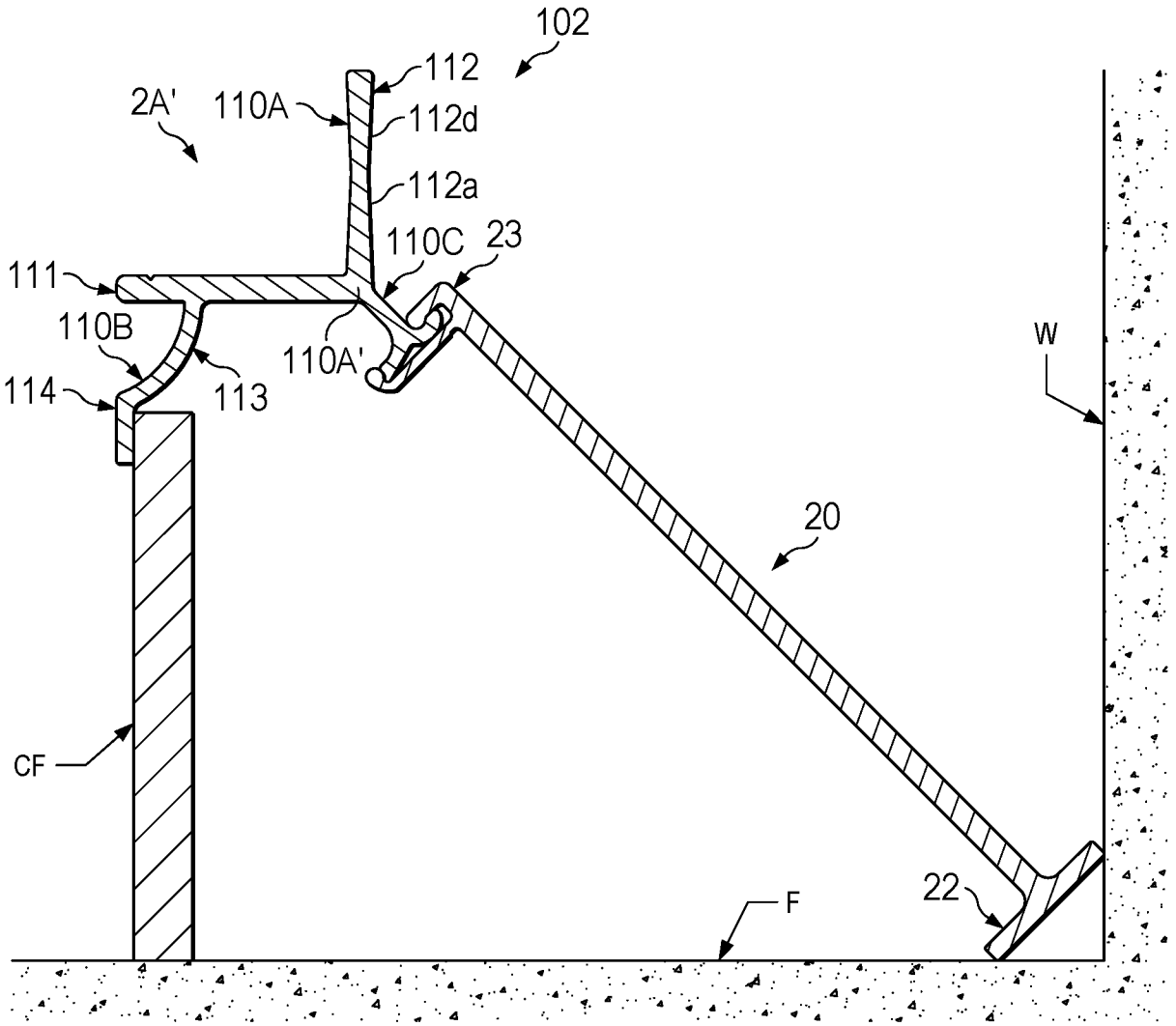
FIG. 9 (FIG. 9) is a cross section of the grate frame assembly taken at line 3-3 of FIG. 2, showing a second embodiment of an embed grate frame according to an aspect of the present disclosure.

Referring to FIGS. 9 and 10, first member 2A' comprises a main body 110A, a leg 110B, and a protrusion 110C. Leg 110B and protrusion 110C are integral with main body 110A and extend outwardly therefrom, as will be described later herein.

Main body 110A is generally L-shaped and includes a first arm 111 and a second arm 112 which intersect one another at a corner 110A'. The intersection of the first arm 111 and the second arm 112 is at any angle which will allow bearing bars to be securely set into an area created by the intersection of the first arm 11 and the second arm 112. As illustrated, first arm 111 is orthogonal to second arm 112.

Referring now to FIGS. 10, 11, 12 and 12A, the first arm 111 includes a first side 111*a* opposite to a second side 111*b*. Second side 111*b* includes a first section 111*b*' and a second section 111*b*". First section 111*b*' and second section 111*b*" are substantially aligned with one another. The first section 111*b*' extends from corner 110A' to leg 110B. The second section 111*b*" extends from leg 110B to an end 111*d* of first arm 111. End 111*d* is substantially perpendicular to the first side 111*a* and the second side 111*b* and is the furthest most point on the first arm 111 from the corner 110A'. The end 111*d* is further continuous with the first side 111*a* and the second side 111*b*. The first side 111*a* of the first arm 111 further defines a groove 111*e* therein. Groove 111*e* extends downwardly from the first side 111*a* to the second side 111*b*. As illustrated, the groove 111*e* is located closer to the end 111*d* of first arm 111 than to the corner 110A' of the first arm 111 and the second arm 112. Groove 111*e* extends for substantially the entire length of first member 2A'. Groove 111*e* is V-shaped in configuration. In other embodiments, groove 111*e* may be of a different configuration, for example, the groove may be concavely curved.

As shown in FIGS. 9, 10, 11, 12 and 12A, leg 110B extends outwardly from first arm 111 of main body 110A. In particular, leg 110B extends outwardly away from second side 111*b* of first arm 111. Leg 10B includes a first region 113 and a second region 114, which intersect one another at a corner 110B'. The first region 113 is arcuately curved and includes a first surface 113*a* and a second surface 113*b* opposite to one another.

The first region 113 of the leg 110B is continuous with the second side 111*b* of the first arm 111 of the main body 110A. In particular, the first surface 113*a* of first region 113 is continuous with the first section 111*b*' of second side 111*b*. The second surface 113*b* of the first region 113 of the leg 110B is continuous with the second section 111*b*" of second side 111*b* of first arm 111.

The second region 114 of the leg 110B includes a first side 114*a* and a second side 114*b* opposite to one another, wherein both the first side 114*a* and the second side 114*b* are substantially parallel to the end 111*d* of the first arm 111 of the main body 110A. Second region 114 terminates in an end 116. The end 116 of the leg 110B is continuous with the first side 114*a* and second side 114*b* of the second region 114 of the leg 110B. The end 116 is substantially perpendicular to the first side 114*a* and the second side 114*b*.

The first region 113 and the second region 114 are integral with one another and the first surface 113*a* of the first region 113 and the first side 114*a* of the second region 114 intersect at the corner 110B'.

Unless explicitly stated that a particular shape or configuration of a component is mandatory, any of the elements, components, or structures discussed herein may take the form of any shape.

Various inventive concepts may be embodied as one or more methods, of which an example has been provided. The acts performed as part of the method may be ordered in any suitable way. Accordingly, embodiments may be constructed in which acts are performed in an order different than illustrated, which may include performing some acts simultaneously, even though shown as sequential acts in illustrative embodiments.

While various inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms.

The articles "a" and "an," as used herein in the specification and in the claims, unless clearly indicated to the contrary, should be understood to mean "at least one." The phrase "and/or," as used herein in the specification and in the claims (if at all), should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc. As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

While components of the present disclosure are described herein in relation to each other, it is possible for one of the components disclosed herein to include inventive subject matter, if claimed alone or used alone. In keeping with the above example, if the disclosed embodiments teach the features of A and B, then there may be inventive subject matter in the combination of A and B, A alone, or B alone, unless otherwise stated herein.

As used herein in the specification and in the claims, the term "effecting" or a phrase or claim element beginning with the term "effecting" should be understood to mean to cause something to happen or to bring something about. For example, effecting an event to occur may be caused by actions of a first party even though a second party actually performed the event or had the event occur to the second party. Stated otherwise, effecting refers to one party giving another party the tools, objects, or resources to cause an event to occur. Thus, in this example a claim element of "effecting an event to occur" would mean that a first party is giving a second party the tools or resources needed for the second party to perform the event, however the affirmative single action is the responsibility of the first party to provide the tools or resources to cause said event to occur.

When a feature or element is herein referred to as being "on" another feature or element, it can be directly on the other feature or element or intervening features and/or elements may also be present. In contrast, when a feature or element is referred to as being "directly on" another feature or element, there are no intervening features or elements present. It will also be understood that, when a feature or element is referred to as being "connected", "attached" or "coupled" to another feature or element, it can be directly connected, attached or coupled to the other feature or element or intervening features or elements may be present. In contrast, when a feature or element is referred to as being "directly connected", "directly attached" or "directly coupled" to another feature or element, there are no intervening features or elements present. Although described or shown with respect to one embodiment, the features and elements so described or shown can apply to other embodiments. It will also be appreciated by those of skill in the art that references to a structure or feature that is disposed "adjacent" another feature may have portions that overlap or underlie the adjacent feature.

Spatially relative terms, such as "under", "below", "lower", "over", "upper", "above", "behind", "in front of", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if a device in the figures is inverted, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly. Similarly, the terms "upwardly", "downwardly", "vertical", "horizontal", "lateral", "transverse", "longitudinal", and the like are used herein for the purpose of explanation only unless specifically indicated otherwise.

Although the terms "first" and "second" may be used herein to describe various features/elements, these features/elements should not be limited by these terms, unless the context indicates otherwise. These terms may be used to distinguish one feature/element from another feature/element. Thus, a first feature/element discussed herein could be termed a second feature/element, and similarly, a second feature/element discussed herein could be termed a first feature/element without departing from the teachings of the present invention.

An embodiment is an implementation or example of the present disclosure. Reference in the specification to "an embodiment," "one embodiment," "some embodiments," "one particular embodiment," "an exemplary embodiment," or "other embodiments," or the like, means that a particular feature, structure, or characteristic described in connection with the embodiments is included in at least some embodiments, but not necessarily all embodiments, of the invention. The various appearances "an embodiment," "one embodiment," "some embodiments," "one particular embodiment," "an exemplary embodiment," or "other embodiments," or the like, are not necessarily all referring to the same embodiments.

If this specification states a component, feature, structure, or characteristic "may", "might", or "could" be included, that particular component, feature, structure, or characteristic is not required to be included. If the specification or claim refers to "a" or "an" element, that does not mean there is only one of the element. If the specification or claims refer to "an additional" element, that does not preclude there being more than one of the additional element.

As used herein in the specification and claims, including as used in the examples and unless otherwise expressly specified, all numbers may be read as if prefaced by the word "about" or "approximately," even if the term does not expressly appear. The phrase "about" or "approximately" may be used when describing magnitude and/or position to indicate that the value and/or position described is within a reasonable expected range of values and/or positions. For example, a numeric value may have a value that is +/−0.1% of the stated value (or range of values), +/−1% of the stated value (or range of values), +/−2% of the stated value (or range of values), +/−5% of the stated value (or range of values), +/−10% of the stated value (or range of values), etc. Any numerical range recited herein is intended to include all sub-ranges subsumed therein.

Additionally, the method of performing the present disclosure may occur in a sequence different than those described herein. Accordingly, no sequence of the method should be read as a limitation unless explicitly stated. It is recognizable that performing some of the steps of the method in a different order could achieve a similar result.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively.

To the extent that the present disclosure has utilized the term "invention" in various titles or sections of this specification, this term was included as required by the formatting requirements of word document submissions pursuant the guidelines/requirements of the United States Patent and Trademark Office and shall not, in any manner, be considered a disavowal of any subject matter.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of various embodiments of the disclosure are examples and the disclosure is not limited to the exact details shown or described.

What is claimed is:

1. A grate frame assembly comprising:

an embed grate frame having a protrusion running along a length of the embed grate frame;

at least one anchor;

wherein the at least one anchor is removably attachable to the protrusion of the embed grate frame anywhere along the length of the embed grate frame;

wherein the at least one anchor comprises:

a body;

a support end provided on the body, said support end being configured to engage at least one wall;

an attachment end provided on the body opposite the support end;

wherein the attachment end is removably attachable with the protrusion of the embed grate frame;

wherein the attachment end further comprises:

a first ledge and a second ledge extending outwardly in a same direction from the body;

a first side extending between the first ledge and the second ledge;

a channel bounded and defined by the first ledge, the first side, and the second ledge;

wherein the channel is adapted to detachably receive a portion of the protrusion of the embed grate frame therein;

wherein the first ledge comprises:

a first surface and a second surface opposite one another;

a first end extending between the first surface and the second surface; and a slot defined by a junction between the second surface and the end;

wherein the second ledge comprises:

a first surface and a second surface opposite one another;

a first end extending between the first surface and the second surface of the second ledge;

a passage defined by the junction between the first surface and the first end of the second ledge;

an inset defined by a junction between the second surface of the second ledge and the body of the anchor; and wherein the first end of the second ledge is enlarged.

2. The grate frame assembly according to claim 1, wherein the second ledge extends further outwardly from the attachment end of the body than does the first ledge.

3. The grate frame assembly according to claim 1, wherein the first end of the first ledge is enlarged.

4. The grate frame assembly according to claim 3, wherein the first end of the first ledge is bulbous.

5. The grate frame assembly according to claim 1, wherein the first end of the second ledge is hooked.

6. The grate frame assembly according to claim 1, wherein the support end extends outwardly from the body of the anchor.

7. The grate frame assembly of claim 1, wherein the embed grate frame comprises:

a main body; and wherein the protrusion extends outwardly from the main body.

8. The grate frame assembly of claim 7, wherein the main body of the embed grate frame comprises a first arm and a second arm, wherein the first arm and second arm intersect one another.

9. The embed grate frame of claim 8, wherein the protrusion extends outwardly from the main body proximate the intersection of the first arm and the second arm.

10. The grate frame assembly of claim 7, wherein the protrusion of the embed grate frame comprises:

a stem extending outwardly from the main body, said stem having a first side and a second side;

a first flange extending outwardly from the stem;

a second flange extending outwardly from the stem;

wherein the first flange comprises a first surface and a second surface opposite one another, and wherein the first surface is continuous with the first side of the stem.

11. The grate frame assembly of claim 10, wherein the first ledge of the attachment end engages the first flange of the protrusion and the second ledge of the attachment end engages the second flange of the protrusion.

12. The grate frame assembly of claim 10, wherein the attachment end of the at least one anchor snap-fittingly engages with the protrusion.

13. The grate frame assembly of claim 10, wherein the first flange and the second flange of the protrusion differ in configuration from one another.

14. The grate frame assembly of claim 1, wherein the embed grate frame comprises:

a main body;

a leg extending outwardly from the main body;

wherein the leg is configured to engage at least one concrete form.

15. The embed grate frame of claim 1, further comprising a leg extending outwardly from the main body, wherein the leg is located remote from the intersection of the first arm and the second arm.

* * * * *